US011350798B2

(12) United States Patent
Burgo, Sr. et al.

(10) Patent No.: US 11,350,798 B2
(45) **Date of Patent: *Jun. 7, 2022**

(54) FAUCET SYSTEM COMPRISING A LIQUID SOAP DELIVERY LINE

(71) Applicant: Gary A. Burgo, Sr., North Port, FL (US)

(72) Inventors: Gary A. Burgo, Sr., North Port, FL (US); Frank M. Burgo, Delray Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/084,577

(22) Filed: Oct. 29, 2020

(65) Prior Publication Data

US 2021/0045589 A1 Feb. 18, 2021

Related U.S. Application Data

(63) Continuation of application No. 16/404,650, filed on May 6, 2019, now Pat. No. 10,856,704, which is a continuation-in-part of application No. 15/996,753, filed on Jun. 4, 2018, now Pat. No. 10,349,787, which is a continuation-in-part of application No. 15/688,450, filed on Aug. 28, 2017, now Pat. No. 10,010,223, which is a continuation-in-part of application No. 15/296,021, filed on Oct. 17, 2016, now Pat. No. 9,777,468, which is a continuation-in-part of application No. 14/941,652, filed on Nov. 15, 2015, now abandoned, which is a continuation-in-part of application No. 14/512,387, filed on Oct. 11, 2014, now abandoned.

(60) Provisional application No. 61/890,483, filed on Oct. 14, 2013.

(51) Int. Cl.

| | |
|---|---|
| ***A47K 5/12*** | (2006.01) |
| ***E03C 1/04*** | (2006.01) |
| ***E03C 1/046*** | (2006.01) |

(52) U.S. Cl.

CPC ..... *A47K 5/1217* (2013.01); *A47K 5/1202* (2013.01); *E03C 1/0404* (2013.01); *A47K 2005/1218* (2013.01); *E03C 1/046* (2013.01)

(58) Field of Classification Search

CPC ..... E03C 1/046; A47K 5/1217
USPC ..... 4/668, 623, 628, 675, 678
See application file for complete search history.

(56) References Cited

U.S. PATENT DOCUMENTS

| | | | |
|---|---|---|---|
| 3,459,207 | A | 8/1969 | Bacheller |
| 4,282,430 | A | 8/1981 | Hatten et al. |
| 4,633,906 | A | 1/1987 | Tuchman |
| 5,245,177 | A | 9/1993 | Schiller |
| 5,625,908 | A | 5/1997 | Shaw |
| 5,760,390 | A | 6/1998 | Vezzalini et al. |
| RE37,888 | E | 10/2002 | Cretu-Petra |

(Continued)

*Primary Examiner* — Christine J Skubinna
(74) *Attorney, Agent, or Firm* — Tracy Jong Law Firm; Cheng Ning Jong; Louis Reale

(57) ABSTRACT

A water faucet system including a faucet having a neck comprising a water passageway and liquid soap delivery line, both integrated within the neck assembly. The water faucet system features a streamlined neck assembly that includes a water outlet or spout, located at the distal portion of the neck assembly, and additionally includes a separate soap outlet located at a predetermined location. The soap delivery (soap dispensing) is initiated by a user performing an activation event directed to a sensor system located in the neck assembly. In preferred embodiments, the sensor system utilizes touchless type sensors so to avoid any physical contact with the neck assembly.

20 Claims, 14 Drawing Sheets

(56) References Cited

U.S. PATENT DOCUMENTS

| | | | |
|---|---|---|---|
| 6,962,168 | B2 | 11/2005 | McDaniel et al. |
| 7,025,227 | B2 | 4/2006 | Oliver et al. |
| 7,406,722 | B2 | 8/2008 | Fukuizumi et al. |
| 7,458,523 | B2 | 12/2008 | Hyslop |
| 7,647,653 | B1 | 1/2010 | Catania |
| 7,819,289 | B2 | 10/2010 | Willis et al. |
| 2004/0211000 | A1 | 10/2004 | Buonocore |
| 2010/0238139 | A1 | 9/2010 | Goertz et al. |

FAUCET SYSTEM COMPRISING A LIQUID SOAP DELIVERY LINE

PRIORITY CLAIM AND RELATED APPLICATIONS

This continuation application claims the benefit of priority from non-provisional application Ser. No. 16/404,650 filed on May 6, 2019 which in turn claims the benefit of priority from non-provisional application Ser. No. 15/996,753 filed on Jun. 4, 2018 which in turn claims the benefit of priority from non-provisional application Ser. No. 15/688,450 filed on Aug. 28, 2017 which in turn claims the benefit of priority from non-provisional application Ser. No. 15/688,450 filed on Aug. 28, 2017 which in turn claims the benefit of priority from non-provisional application Ser. No. 15/296,021 filed on Oct. 17, 2016 which in turn claims the benefit of priority from non-provisional application Ser. No. 14/941,652 filed on Nov. 15, 2015 which in turn claims the benefit of priority from non-provisional application Ser. No. 14/512,387 filed on Oct. 11, 2014 which in turn claims the benefit of priority from the provisional application U.S. Ser. No. 61/890,483 filed on Oct. 14, 2013. Each of said applications is incorporated by reference in its entirety.

FIELD OF THE INVENTION

This invention generally relates to a water faucet system comprising a faucet having a neck including an integrated soap delivery line contained therein. In a more specific aspect of the present invention, the delivery or dispensing of liquid soap is initiated by a user, via activation event, detected by an electronic sensing system and cooperating control module.

BACKGROUND OF THE INVENTION

Known in the art are the simple liquid soap dispensers designed as a standalone units for use in the vicinity of water faucets. Such portable units are typically found on a flat surface in the vicinity of a water faucet (e.g. shelf, windowsill, cabinet top, countertop, or the like), and are sometimes referred to as countertop soap dispensers. Other versions of liquid soap type dispensers are designed to mount to a wall, typically located in the vicinity of a faucet(s) it serves. Some of these present-day soap dispenser designs incorporate a mechanical pump where the user is required to manipulate a pump member (e.g. lever, button, or the like) with one hand, while receiving the soap in the other; while other similar dispenser designs incorporate a proximity sensing system enabling the user to automatically receive soap without having to manipulate a pump member. These ubiquitous liquid soap dispensers tend to be cumbersome, unsightly (especially in elegantly finished environments), and possess a multitude of drawbacks. The pump member incorporated in manual pump style soap dispensers are often manipulated by soiled hands. Once used, a contaminated pump member often remains contaminated, polluting the pump member surface for the next user(s), unless each user makes the (unlikely) effort to include washing the pump member as part of their washing routine. Both countertop as well as wall mounted units tend to suffer from small soap reservoirs, creating the burden of frequent monitoring and refilling. Additionally, spill-over from wall mounted units, as well as leakage from unstable countertop units (especially when accidently knocked into onto the floor) can create slip hazards, which are particularly worrisome due to associated safety and liability issues. Of additional concern are soap residue type stains, which are particularly stubborn to remove once allowed to dry; prompting frequent monitoring and quick cleanups. Also, included within the relevant prior art, are less well known liquid soap dispensers that are integrated into commonplace faucet systems. Such integrated systems discussed in the prior art, like the aforementioned standalone or countertop units, are also overrun with a multitude of drawbacks. For example, U.S. Pat. No. 7,458,523 (to Hyslop) describes a soap foam dispensing faucet wherein the dispensing of the soap is substantially coupled with the water output outlet. In one embodiment, both the soap and the water outputs exit from the same aerator screen typically reserved solely for water. In another embodiment, the soap is dispensed via a soap dispensing outlet disposed just adjacent to the water outlet; essentially creating a single receiving location for both soap and water. A soap dispensing outlet that is spatially indistinguishable from a water dispensing outlet, suffers from similar serious drawbacks. None of the embodiments disclosed enables the user to dispense solely soap; other drawbacks originate from the leakage, dripping, or the mixing of soap residue with clean water, when the user requests/expects clean water. Several user safety/comfort issues arise when the user's clean water request is inadvertently contaminated by soap. For example, a drop or so of soap is all that is required to contaminate or foul the taste of a glass of drinking water or container of water for cooking purposes. Similarly, a user that has unknowingly washed their contact lenses with soap contaminated water will be at risk for eye irritation, allergic reactions, and the like; once the soap contaminated lenses are installed onto the eyes.

Again, referring back to the system disclosed by U.S. Pat. No. 7,458,523 (to Hyslop), water flow duration, soap dispensing duration, water/soap mixing ratio, water temperature, among other characteristics are programmed into the system and are not adjustable in real time. Additionally, it is not possible for a user to solely request either water or soap.

Accordingly, in view of the foregoing deficiencies, there exists a clear motivation in the soap dispensing arts for new and useful improvements.

SUMMARY OF THE INVENTION

The present invention is directed to a water faucet system, including a faucet having a neck comprising a water passageway and liquid soap delivery line, both integrated within the neck assembly. The water faucet system features a streamlined neck assembly that includes a water outlet or spout located at the distal portion of the neck assembly, and additionally includes a separate soap outlet, distinctly located at a predetermined location prior to the spout. The soap outlet furnishes a user with a soap delivery zone for dispensing liquid soap or soap, and is strategically located such that virtually all of the soap splatter and/or post-pump soap drippings will safely fall into the corresponding sink below, where normal use of the faucet enables a self-cleaning strategy, where running water will eventually wash away any residue.

Even though the liquid soap delivery line is integrated within the neck assembly, the soap contained within the soap delivery line is completely isolated from the water stream directed to the spout, so to avoid any cross contamination between the two liquids (soap and water).

In preferred embodiments, the neck assembly is an elongated neck (e.g. gooseneck type, or the like), which provides ample room, between the spout (water outlet) and the soap outlet, when properly positioned to further reduce the opportunity for cross contamination during use. Additionally, the soap delivery (soap dispensing) will be initiated by a user, who performs an activation event directed to a sensor system configured into the neck assembly. In preferred embodiments, the sensor system utilizes touchless type sensors so to avoid any physical contact with the neck assembly; but, sensors requiring physical contact are also included as viable, given the embodiment possibilities. System sensors are selected to produce a neck system that is streamlined and aesthetically pleasing. In some embodiments, the sensor(s) can be embedded into the neck assembly so that it is below or flush to the neck surface. Also conceived, are sensor systems that are activated via a voice command(s), sound command(s) (e.g. hand clap) or the like, thus aligning with the touchless sensor philosophy.

A soap storage tank will supply the liquid soap to one or more faucets or faucet systems of the present invention. The soap storage tank should be of sufficient size so to reduce the refilling maintenance requirement for the system. Using a soap concentrate combined with real-time addition of water will further reduce the frequency associated with soap refilling maintenance. Additionally, in preferred embodiments, it is expected that the tanks be installed in hidden (out-of-view) locations, yet remain easily accessible (e.g. below sink cabinetry, behind walls or mirrors, or the like).

In the present invention, controlling the water stream emanating from the spout (with respect to water flow rate and/or temperature), can be accomplished via any known means, including touchless sensor, standard manual knobs or levers (e.g. single lever, dual knobs), or the like.

Accordingly, it is object of the present invention to provide a faucet system with a faucet neck assembly including: soap delivery zone provided by a soap outlet, a sensor system for activating soap delivery. The soap outlet and water spout are substantially separated so to prevent the water stream being contaminated with soap when solely water is desired (e.g. obtaining drinking water, cooking water, the washing of sensitive items (e.g. contact lenses), and the like).

It is another object of the present invention to clearly separate the request and delivery of water from the request and delivery of soap. Each request (water verses soap) is distinct, without any codependency. The system enables the sole request and sole delivery of water; as well as the sole request and sole delivery of soap.

It is yet another object directed to particular embodiments of the present invention to provide a predetermined sensor system used in conjunction with a specific use faucet (e.g. hands washing, salon hair shampooing, pet bathing and the like). Sensor system detection schemes include proximity, beam-break designs, and well as touch activated designs. The type of liquid soap utilized can be selected from a multitude of varieties depending on specific use, location, and the like. For example, the use of a shampoo type of liquid soap directed to a hair washing station in a hair salon.

It is yet another object directed to particular embodiments of the present invention to provide a service light to provide one or more functions. For example, a service light configured into the faucet neck at a location neighboring the soap outlet, would help a user promptly locate the soap outlet and associated soap delivery zone in dim light conditions. Additional service light functions include, but not limited to, providing a means for detecting a low soap level in the soap storage tank, a power failure, a low battery indicator, or the like.

It is yet another object of the present invention to provide a control module including a module power source (e.g. battery, AC line voltage). The function of the control module is to manage or control the logical/electrical operations of the faucet system of the present invention. Controlling functions include: operating the sensor system, timing soap dispensing duration, initiating soap delivery, and the like.

It is further object of the present invention, directed to particular embodiments, to include a means for producing a foam soap or foam-soap.

It another object of the present invention, directed to particular embodiments, to include a means for pumping or transporting soap that is powered via water pressure (from a pressurized water supply) to reduce power consumption of the system.

It is yet another object of the present invention to provide a water flush or soap purge of at least a portion of the soap delivery line and associated soap outlet comprising a short duration delivery of water. Purging the soap from the soap delivery system will help prevent soap buildup; a well known cause of soap delivery line type clogs, and other related issues.

It is further object of the present invention, directed to particular embodiments, to include a customer replaceable cartridge or customer replaceable unit (CRU), containing at least a soap storage tank. Another more comprehensive CRU would also contain a battery that functions as the system main power source or a backup power source during a power or system failure. The customer replaceable unit (CRU) serves to provide a user with a quick, simple means for replacing the consumables associated with the present invention (soap, battery power, and the like). Similarly, yet another version of the CRU system is designed to service two or more faucet systems (faucet network).

It another object of the present invention, directed to particular embodiments, to include a means for activating a soap delivery utilizing a beam-break sensor system. Beam-break benefits include distinct detection boundaries and fast response times providing a user with a clear distinct activation area or location that enables the hand motion from the user or activation event to immediately initiate a soap delivery.

It is yet another object the present invention, directed to particular embodiments, to include a means for activating a soap delivery to include at least two beam-break sensor systems. The utilization of at least two detection beams for soap delivery, providing greater convenience to a user by offering more than one location to initiate a soap delivery.

It is further object of the present invention, to position sensor systems for activating a soap delivery, including detection beams from beam-break sensor systems, in a low traffic area. The low traffic area is an area of little to no user engagement that is located above the water spout level line. Placement of sensor systems for activating a soap delivery, especially beam-break sensor systems, will help reduce/eliminate accidental soap delivery.

It is another object of this invention to provide a relatively simple system that is economical from the viewpoint of the manufacturer and consumer, is susceptible to low manufacturing costs with regard to labor and materials, and which accordingly evokes low prices for the consuming public, thereby making it economically available to the buying public.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

Particular Advantages of the Invention

The present invention provides a relatively simple, cost-effective, efficient solution directed to a versatile faucet system that solves a multitude of practical as well as aesthetic issues directed to faucets and faucet environments. The primary focus of the present invention is to provide an aesthetically pleasing faucet system that incorporates a sensor activated soap delivery system integrated into the faucet's neck assembly. The faucet system of the present invention will eliminate the need for cheap, unstable countertop type soap dispensers that suffer from a multitude of problems, and in many respects, are comparable the drawbacks of the everyday bar of soap scenario (i.e., unsightly, unstable-often dropped, unsanitary, and the like).

Additional advantages of the faucet system of the present invention include distinctly separate delivery points for water and soap so not to unintentionally intermix the two. The system enables the sole request and sole delivery of water; as well as the sole request and sole delivery of soap.

BRIEF DESCRIPTION OF THE DRAWINGS

The ensuing detailed description section makes reference to the annexed drawings. An enhanced understanding of the present invention will become evident when consideration is given to the detailed description thereof and objects other than the aforementioned become apparent. The invention will be described by reference to the specification and the annexed drawings, in which like numerals refer to like elements, and wherein.

DEFINITIONS OF TERMS USED IN THIS SPECIFICATION

Figure 1:
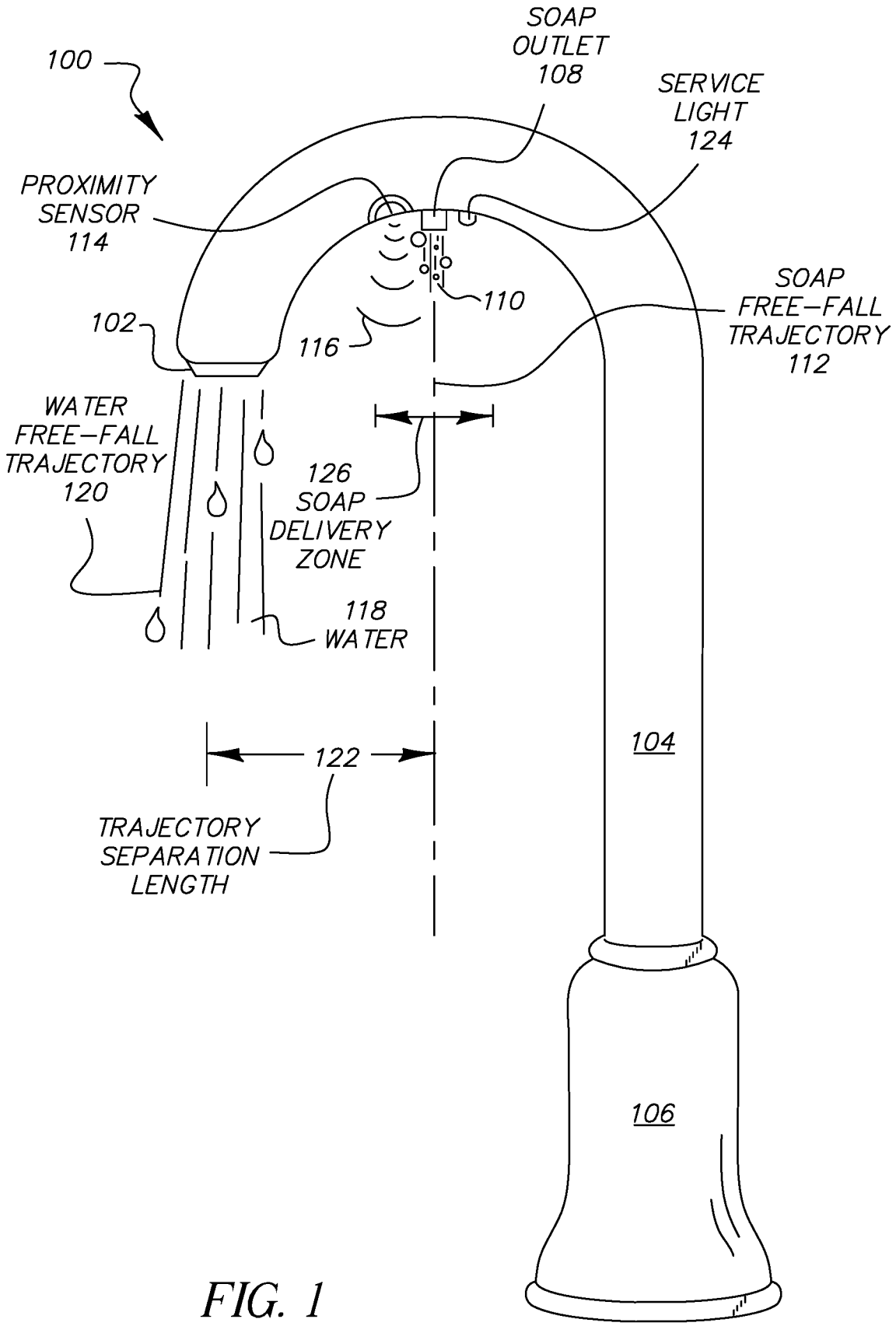
FIG. 1 illustrates an orthogonal side view of an exemplary faucet 100, possessing a simple arch elongated neck assembly. The Figure depicts a single proximity sensor 114 mounted onto neck 104.

The faucet system comprising a liquid soap delivery line discussed throughout this disclosure shall have equivalent nomenclature, including the device, the soap delivery system, the (water) faucet system, the system, the present invention, or the invention. Additionally, the term exemplary shall possess a single meaning throughout this disclosure; wherein the sole definition pertains to serving as an example, instance, or illustration.

The term elongated neck is defined as the portion of the faucet that originates at the horizontal base portion of the faucet and terminates with the water outlet or spout (which typically incorporates an aerator screen); and it is understood to include, but not limited to, all gooseneck type designs which are characterized by their distinctive arciform or bowed geometry. Other member geometries include faucet necks constructed from a plurality of substantially linear segments, curvilinear segments, or any combination thereof. The term neck, faucet neck, faucet neck assembly, or neck assembly, are all equivalently defined and are understood to encompass all variations of faucet neck designs including short length versions as well as those covered by the aforementioned elongated neck definition.

The term liquid soap or soap is defined as any fluid or material that can be delivered via a tubular member (soap delivery line) and is understood to include: hand and facial soaps, dish washing detergents, moisturizing lotions, shampoos, and the like. The liquid soap or soap term is defined to include the air-free as well as foam versions of the fluid or material. A more general title for the liquid soap or soap terms is the output or dispensed fluid or material.

The term soap delivery line is understood to include the complete path taken by the soap in the present invention. Wherein the path starts with a soap storage tank and terminates at the soap outlet incorporated within the neck of the faucet.

The term activation event or motion activation is defined as any user gesture that is detectable by the sensor system of the present invention. The sensor system is comprised of at least one sensor that is adapted to detect a user's hand, forearm, or the like, such that an activation signal is generated when the sensor(s) is triggered by the user. The generated activation signal or trigger signal, when created, is interpreted by the control module to produce the conditions to dispense liquid soap. It is understood that the activation event term includes touchless as well as physical contact means for activation produced by the user upon the sensor system (control module monitored). Note that touch is required in certain capacitance based sensing systems. The sensor system used to detect a user's hand, forearm, or the like, can be accomplished by a variety of sensor types having appropriate, well known, supporting infrastructure. Such sensor systems available include, but not limited to: beam-break sensor systems which includes reflection based detection systems based on light or laser based type sensors; proximity type sensors, including heat (IR) sensors, capacitance sensors, ultrasonic sensors; also included are simple switch type of devices that are sensitive to the touch; or any combination thereof. The aforementioned sensors or sensor systems can be either passive or active. In preferred embodiments, a sensing system will provide a safe, reliable method of detection that lends itself to compact, non-obtrusive incorporation into the hardware of the present invention.

The term water spout level line is defined as an imaginary line, parallel to the horizon; the line is positioned at the lower portion of the water spout, specifically at the point where the water exits the spout. The water spout level line separates the low traffic, and the high traffic areas of the faucet environment. The high traffic area is defined as the area below the water spout level line, and is characterized as an area where one would typically find a user's arms and hands when interacting with the faucet (e.g., hands washing, drawing water, etc.). The low traffic area is defined as the area above the water spout level line, and is characterized as an area of low user engagement, the area where one would not typically find a user's arms and hands when interacting with the water stream delivered by the faucet. In preferred embodiments, it is recommended that the detection beam for soap delivery, in its entirety, completely reside within low traffic area of the faucet environment to prevent accidental soap delivery. In contrast, for the convenience of the user(s), it is recommended that at least a portion of a detection beam for water delivery, reside in the high traffic area of the faucet environment to enable quick, convenient activation or reactivation of the water stream.

To help facilitate disclosure understanding and streamline the location of figures and associated part numbers, a systematic parts/features numbering convention has been employed. The first digit in three digit part numbers refers to the figure number where the part was first introduced, or is best depicted. Likewise, in four digit part numbers, the first two digits refer to the figure number where the part was first introduced, or is best depicted. Although this disclosure may at times deviate from this convention, it is the intention of this numbering convention to enable expeditious comprehension of the disclosure.

PARTS/FEATURES LIST

100. faucet (simple arch elongated neck)
102. spout (water outlet)
104. neck (arched elongated neck assembly)
106. base
108. soap outlet
110. soap
112. soap free-fall trajectory
114. proximity sensor
116. detection zone (sensor)
118. water (tap water delivery from spout 102)
120. water free-fall trajectory
122. trajectory separation length
124. service light
126. soap delivery zone
200. faucet (inverted arch elongated neck)
202. spout (water outlet)
204. neck (inverted arch elongated neck assembly)
206. base
208. soap outlet
210*a*. first sensor
210*b*. second sensor
212. detection beam
214. soap delivery line
216. tubular structure
218. inner volume (provides a water passageway)
220. water flow path (through inner volume 218)
222. dedicated water passageway (portion of line shown)
300. faucet (inverted arch elongated neck)
302. spout (water outlet)
304. neck (inverted arch elongated neck assembly)
306. base
310*a*. first sensor
310*b*. second sensor
312. detection beam
314. user or user's hand
316. elbow
400. faucet (single handle)
402. spout (water outlet)
404. neck
406. base
408. soap outlet
410. proximity sensor
412. handle (single handle design for water control)
414. service light
500. faucet (faucet 400, dispensing soap and water)
510. soap
512. soap free-fall trajectory
518. water
520. water trajectory
522. trajectory separation length
524. spacing
600. soap delivery system (depicted in liquid soap delivery mode)
602. water gate (pump, check-valve, flow valve, or any combination thereof)
604. coupler (subsystem of soap delivery line 620)
606. soap gate (pump, check-valve, flow valve, or any combination thereof)
608. soap outlet
610. soap (liquid soap feed from soap storage tank)
612. soap (liquid soap delivery to user)
614. water (from water source)
616. soap feed line (subsystem of soap delivery line 620)
618. soap gate output line (subsystem of soap delivery line 620)
620. soap delivery line (feeds soap outlet 608)
622. water feed line (connected to water source)
624. water gate output line
626. soap delivery path (system 600 in soap delivery mode)
628. control module
700. soap delivery system (depicted in water flush or water purge mode)
702. water flush path (system 700 in water purge mode)
704. water flush (purging soap delivery line 620 of soap 612)
706. residual soap (soap 610 remaining in line 620 & soap outlet 608)
800. foam soap delivery system (depicted in foam soap delivery mode)
802. foam soap generator
804. air supply line
806. foam soap delivery path (system 800 in foam soap delivery mode)
808. foam soap outlet
810. residual soap (soap 610 in line 620, and foam soap from 802 & 808)
900. foam soap delivery system (depicted in water flush or water purge mode)
902. water flush path (system 900 in water purge mode)
904. water flush (purging soap delivery line 620 & foam outlet 808 of soap)
1000. soap delivery system—water pressure powered (depicted in off state)
1002. soap storage tank
1004. soap concentrate
1006. water feed line (tapped into water source)
1008. water (from pressurized water source)
1010. valve gate (electrically controlled valve and/or check-valve)
1012. valve input line
1014. tank delivery channel
1016. valve delivery channel
1018. control valve (pressure sensitive)
1020. control spring (uncompressed condition—closes control valve 1018 when valve gate 1010 is closed)
1022. soap delivery line
1100. soap delivery system—water pressure powered (depicted in soap delivery mode)
1102. water flow
1104. soap concentrate flow
1106. soap intermixture flow (mix of water flow 1102 and soap concentrate flow
1104)
1108. control spring (compressed condition)
1200. customer replaceable unit (CRU) system (servicing a single faucet)
1202. control module
1204. line power (wall outlet power—direct or stepped down voltage)
1206. battery cable
1208. removable connector
1210. customer replaceable unit (CRU)
1212. battery
1214. battery connector
1216. battery quick connect system
1218. soap storage tank
1220. soap output post (soap storage tank)
1222. removable fitting
1224. soap quick connect system

1226. pump input line
1228. pump
1230. pump output line (to faucet-1)
1232. pump control cable (provides pump control signals)
1234. faucet control signal/power cable (to faucet-1)
1300. customer replaceable unit (CRU) system (servicing a faucet network)
1302. faucet soap line (servicing faucet-1)
1304. faucet soap line (servicing faucet-2)
1306. soap distribution manifold
1308. faucet signal control cable (servicing faucet-1)
1310. faucet signal control cable (servicing faucet-2)
1400. faucet
1402. spout (water outlet)
1403. water spout level line
1404. neck (arch elongated neck assembly)
1406. base
1408. soap outlet
1410*a*. first sensor
1410*b*. second sensor
1412. detection beam
1418. water
1500. faucet
1502. spout (water outlet)
1503. water spout level line
1504. neck (arch elongated neck assembly)
1506. base
1508. soap outlet
1510*a*. first sensor
1510*b*. second sensor
1512. detection beam
1600. faucet
1602. spout (water outlet)
1603. water spout level line
1604. neck (arch elongated neck assembly)
1606. base
1608. soap outlet
1610*a*. first sensor
1610*b*. second sensor
1612. detection beam
1700. faucet
1702. spout (water outlet)
1703. water spout level line
1704. neck (arch elongated neck assembly)
1706. base
1708. soap outlet
1710. soap
1710*a*. first sensor
1710*b*. second sensor
1712. detection beam
1714*a*. user's left hand
1714*b*. user's right hand
1800. faucet
1802. spout (water outlet)
1803. water spout level line
1804. neck (arch elongated neck assembly)
1806. base
1808. soap outlet
1810*a*. first sensor
1810*b*. second sensor
1812. detection beam
1900. faucet
1902. spout (water outlet)
1903. water spout level line
1904. neck (novel elongated neck assembly)
1906. base
1908. soap outlet
1911*a*. first sensor
1911*b*. second sensor
1912. first soap detection beam
1913*a*. first sensor
1913*b*. second sensor
1914. second soap detection beam
1915*a*. first sensor
1915*b*. second sensor
1916. detection beam for water

DETAILED DESCRIPTION

With reference to the drawings of the present invention, several embodiments pertaining to the faucet system of the present invention thereof will be described. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Terminology of similar import other than the words specifically mentioned above likewise is to be considered as being used for purposes of convenience rather than in any limiting sense.

It must be noted that as used herein and in the appended claims, the singular forms "a", "an", and "the" include plural reference unless the context clearly dictates otherwise. As well, the terms "a" (or "an"), "one or more" and "at least one" can be used interchangeably herein. It is also to be noted that the terms "comprising", "including", "characterized by", "possessing" and "having" are all to be interpreted as open ended terms, are all considered equivalent terms, and are used interchangeably.

FIG. 1 illustrates an orthogonal side view of exemplary faucet 100. Faucet 100 includes neck 104 that is configured from an elongated substantially continuous tubular structure possessing a simple arched geometry. The tubular structure can be constructed from a variety of durable materials including plastics (polymeric based materials), composites, metal, metal alloys, or the like. On the lower portion of neck 104, resides base 106; which is typically affixed to a dedicated mounting aperture, typically found on: sink fixtures, countertops, and the like. On the opposing end of neck 104, resides spout 102 that functions as a water outlet for delivering water 118.

Soap outlet 108, proximity sensor 114, and service light 124 are all affixed to the mediate portion of neck 104, located between base 106 and spout 102. More particularly, in this embodiment, soap outlet 108 resides at the arch's point of inflection. Therefore, the arch's point of inflection also lies on the plumb line delineated by soap free-fall trajectory 112. The sensor system includes a motion activated proximity sensor 114, capable of detecting the motion of objects (activation event) within detection zone 116, and is disposed adjacent to soap outlet 108 such that detection zone 116 associated with proximity sensor 114 is substantially coterminous with soap delivery zone 126. This enables a user to conveniently activate proximity sensor 114 in an open handed orientation while simultaneously receiving a delivery of soap 110. It is understood that in certain embodiments, there can exist more than one soap outlet 108 to increase the dispensing volume of soap 110; yet in other embodiments the function of more than one soap outlet 108 can be to provide a means for dispensing a variety of dispensing materials, for example: shampoo from one outlet and hair conditioner from another.

Again, referring to FIG. 1, service light 124 is positioned in relatively close proximity to both soap outlet 108 and proximity sensor 114 so to provide a user, a guide to soap delivery zone 126 serviced by detection zone 116, in low light or like conditions. Service light 124 function can be configured in the form of an LED or Light Emitting Diode, modern day LEDs can be selected from a multitude of colors, sizes, intensity levels, and the like. Service light 124 can be configured to provide a steady state light emission, or any variety of blinking light pattern, including the use of different colored light, since modern day LED technology enables a single LED device to emit more than one color light. Additionally, service light 124 can provide a diagnostic service for the faucet system of the present invention. One embodiment directed to a system diagnostic service will utilize service light 124 to communicate display codes, wherein exemplary codes include: low soap level, low battery, power failure detected, and the like. Service light 124 can be constructed in a variety of configurations, including a single point light source, a plurality of light sources, an illumination ring surrounding soap outlet 108 and/or proximity sensor 114, and the like.

In order to virtually eliminate the opportunity for cross contamination between soap 110 and water 118, in preferred embodiments, it is desirable to physically separate water spout 102 and soap outlet 108, and substantially maximize the distance between them. Water spout 102 delivers water 118 according to the path depicted by water free-fall trajectory 120, and soap outlet 108 delivers soap 110 according to the path depicted by soap free-fall trajectory 112. The separation between water free-fall trajectory 120 and soap free-fall trajectory 112 is delineated by trajectory separation length 122. In preferred embodiments, trajectory separation length 122 is relatively large, preferably in the range of a few inches.

Figure 2:
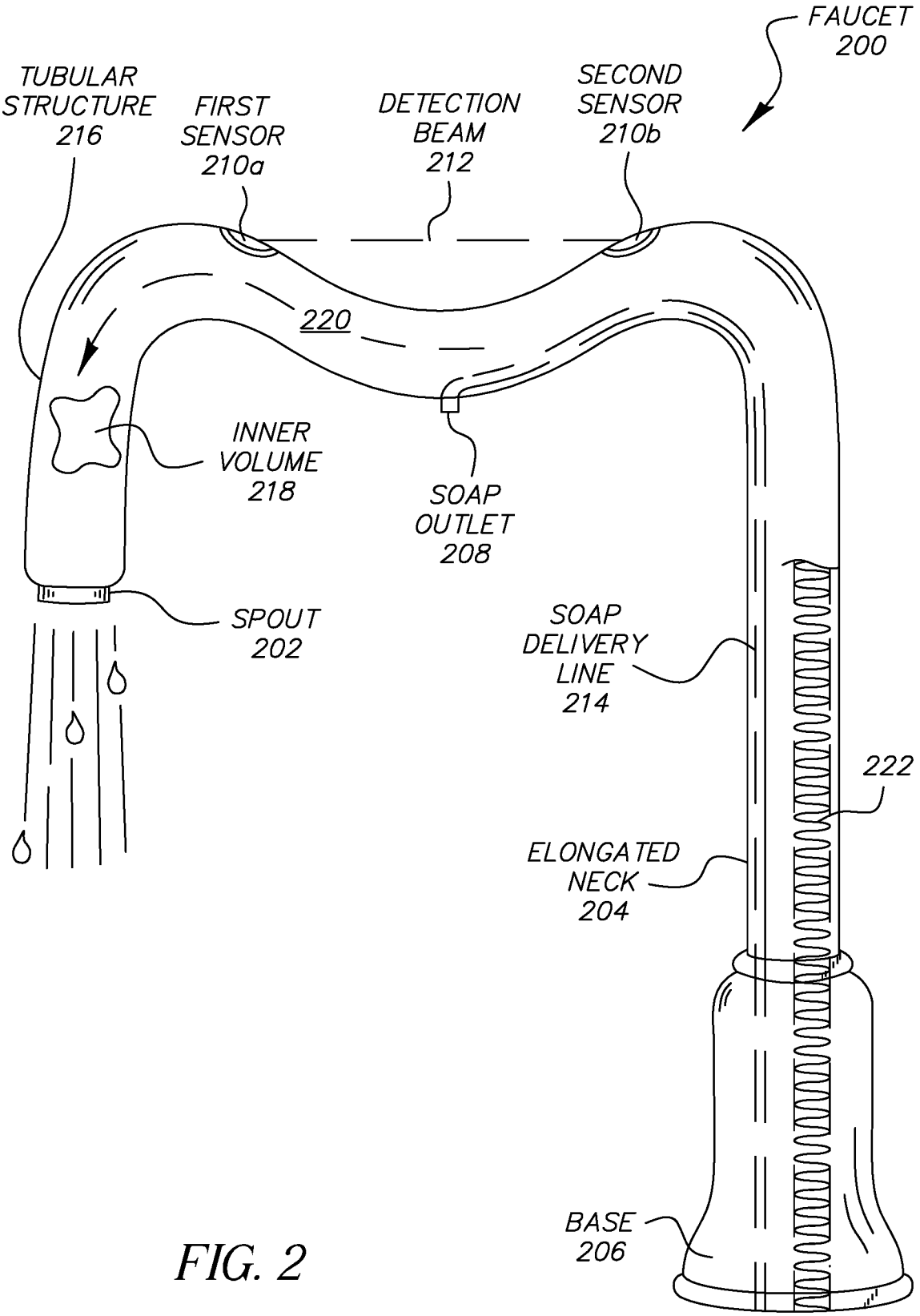
FIG. 2 illustrates a partial sectional, orthogonal side view of an exemplary faucet 200, possessing an inverted arch elongated neck assembly. The Figure depicts a first sensor 210*a* and second sensor 210*b* mounted onto neck 204.

FIG. 2 illustrates a partial sectional, orthogonal side view of exemplary faucet 200. Faucet 200 includes an elongated neck 204 assembly, sporting an inverted arch about the midsection of elongated neck 204. Similar to the objectives discussed pertaining to Faucet 100 embodiment of FIG. 1, Faucet 200 includes soap outlet 208 affixed to the mediate portion of neck 204, located between base 206 and spout 202. The mediate portion includes an inverted arch wherein, by way of example, but not limitation, soap outlet 208 is affixed to the point of inflection corresponding to the bottom portion of the inverted arch.

Neck 204 is configured from an elongated substantially continuous tubular structure 216 that possesses inner volume 218. Inner volume 218 provides water flow path 220 terminating at spout 202 providing a means for delivering a water stream to a user. In alternate embodiments, dedicated water passageway 222 can be installed within inner volume 218, this additional tube or pipe will provide dedicated water delivery service to spout 202. In general, all water faucet systems provide a means for initiating a water stream through a spout. Virtually any water initiating means can be integrated into and fully cooperate with the present invention, initiating means include touchless activation systems as well as manual systems. Examples of manual activation systems, including turn-knob and lever handle types of controls, are disclosed in U.S. Pat. No. 3,459,207 (Bacheller) and U.S. Pat. No. 4,633,906 (Tuchman) both incorporated by reference herein in their entirety. Examples of touch-less or sensor based water activation systems are disclosed in U.S. patent RE37,888 (Cretu-Petra), U.S. Pat. No. 6,962,168 (McDaniel et al.) and U.S. Pat. No. 7,458,523 (Hyslop); all herein incorporated by reference in their entirety.

Depicted within inner volume 218, is soap delivery line 214, a dedicated line for soap delivery, it functions as part of the soap delivery system that enables soap movement from soap storage to soap outlet 208. Soap delivery line 214 is a water-tight sealed tubular delivery system that is configured to coexist with other elements or services residing within inner volume is 218, including water flow path 220, sensor cables, electrical leads, and the like. All fluid delivery lines or paths are understood to be fabricated and assembled in a manner to preclude intermixing or interacting with coexisting elements or services residing within inner volume is 218. Aspects of alternate embodiments include, waterproof sensor cables and electrical leads, dedicated waterproof channels for sensor cables and electrical leads, and the like.

Again referring to FIG. 2, Faucet 200 includes a motion activated, touchless sensor system that utilizes a beam-break sensor configuration. The beam-break sensor configuration utilizes first sensor 210*a* and second sensor 210*b*, both mounted onto opposing sides of the inverted arch located on the top portion of neck 204. The two sensors are optically aligned in a linear configuration so to create a detection beam 212 on the top portion of neck 204; this configuration yields an embodiment with some exceptional benefits. One benefit is directed to the location (top portion of neck 204) of detection beam 212, wherein during normal faucet activity (occurring below neck 204), the motions of the user has virtually no chance of inadvertently engaging detection beam 212. Another benefit is directed to the tight, distinct detection boundaries offered by detection beam 212, coupled by the fast response time typically offered by beam-break sensor type configurations. The beam-break configuration will provide a user with a clear motion or activation event to immediately initiate a soap delivery; unlike some proximity sensor configurations where the detection zone is not precisely defined. Detection zones that are not well defined can lead to accidental activations, and more often force users to wave their hands in random fashion in the vicinity of the proximity sensors in hopes of finding an acceptable gesture that qualifies as an activation event for the sensor system.

Beam-break technology, the art of using at least two sensors or devices in a system for the detection of an object entering into a predetermined area, is substantially well known, and commonly practiced. By way of example, but not limitation, the following publications teach and describe the technology, including exemplary applications: U.S. Pat. No. 4,282,430, granted Aug. 4, 1981; U.S. Pat. No. 5,245,177, granted Sep. 14, 1993; U.S. Pat. No. 5,760,390, granted Jun. 2, 1998; and U.S. Pat. Pub. No. US 2010/0238139 A1, published Sep. 23, 2010; all aforementioned publications are hereby incorporated by reference in their entirety.

Figure 3:
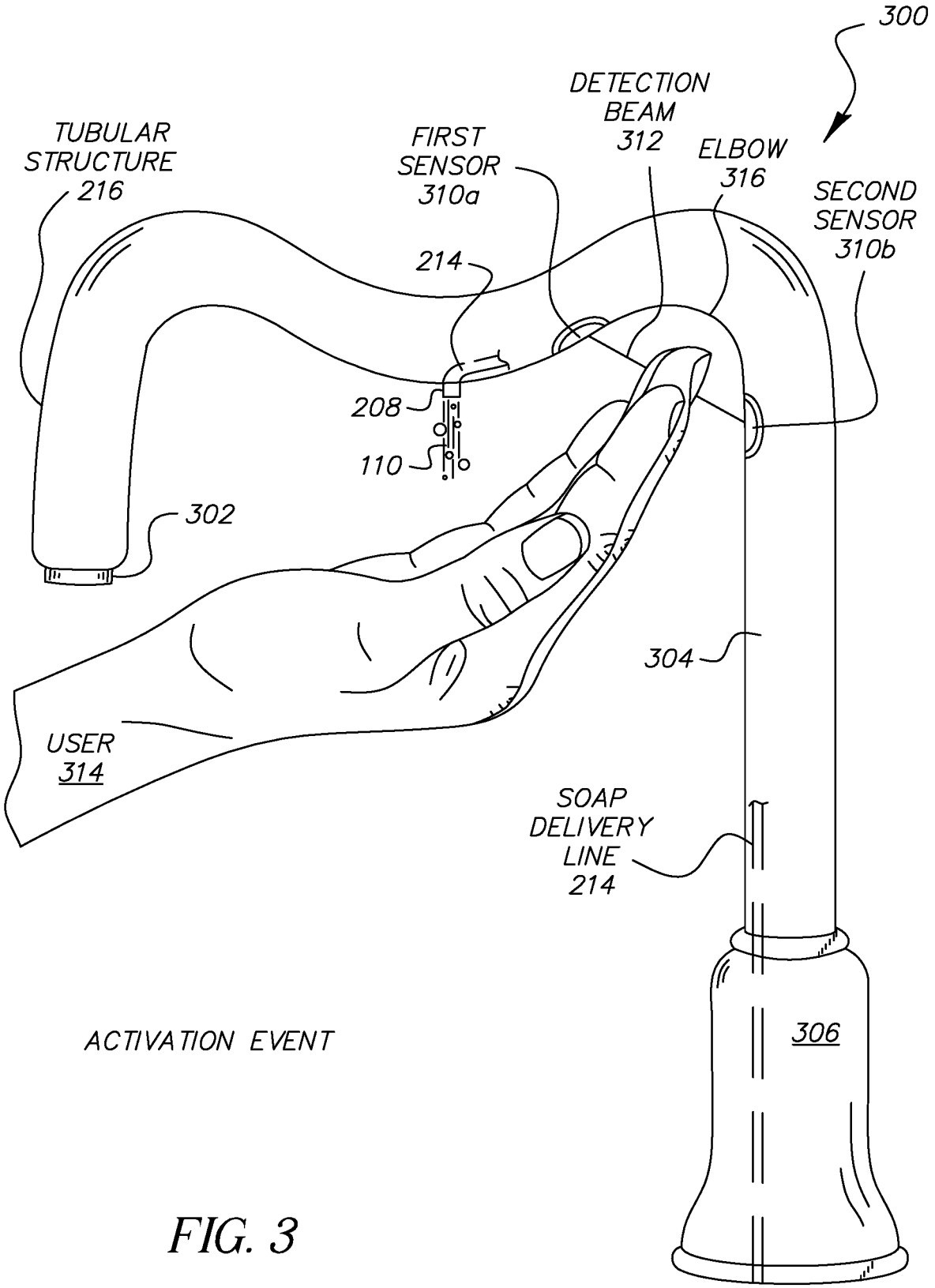
FIG. 3 illustrates an orthogonal side view of an exemplary faucet 300, possessing the inverted arch elongated neck assembly depicted in FIG. 2. The Figure further depicts user's hand 314 engaging detection beam 312.

FIG. 3 illustrates an orthogonal side view of an exemplary Faucet 300. Similar to the layout of Faucet 200 of FIG. 2, Faucet 300 depicts base 306, elongated neck 304 assembly (also sporting an inverted arch)—having a spout 302 attached thereon. Differing from Faucet 200 of FIG. 2, Faucet 300 incorporates a beam-break sensor configuration into arched elbow 316 portion of neck 304. The incorporated beam-break sensor configuration utilizes first sensor 310*a* and second sensor 310*b*, both mounted onto opposing sides of elbow 316 located on the bottom portion of neck 304. The two sensors are optically aligned in a linear configuration so to create a detection beam 312 on the top, underside portion of neck 204 at elbow 316. Benefits of this configuration includes, a reduction of accidental activations, in addition to streamlining user 314 request for a soap delivery and giving user 314 more control over the volume of soap 110 delivered. Depicted are the fingertips associated with user 314 engaging detection beam 312 (a sensor activation event) producing an activation signal, that initiates a soap delivery of soap 110 into the palm of (already properly positioned) user 314. In a specific variation of the present embodiment, the amount or volume of soap 110 delivered into the palm of user 314 can be easily controlled by the user when the system is configured in a one-to-one time relationship between the activation event (engagement with detection beam 312) and the duration of the soap delivery. Another variation of the present embodiment will produce a soap delivery with a predetermined duration (time) given a single activation event (producing a single activation signal) regardless of how many activation signals are generated (given a predetermined timeout period).

Figure 4:
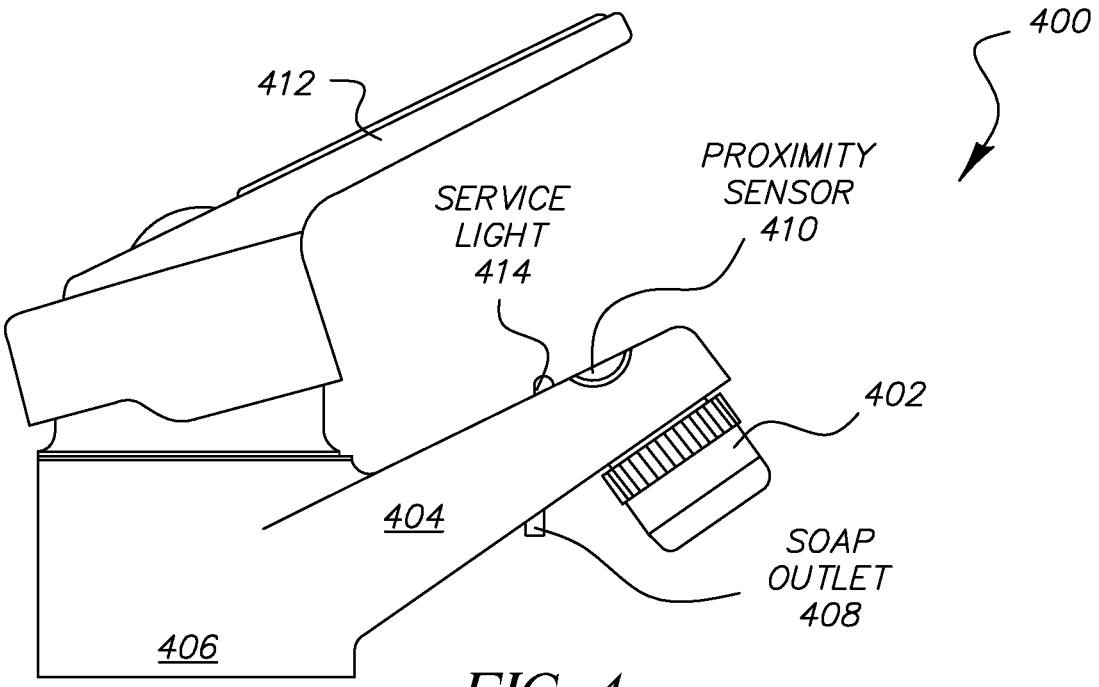
FIG. 4 illustrates an orthogonal side view of an exemplary faucet 400, possessing a short, linear neck assembly. The Figure further depicts a single proximity sensor 410 mounted onto the top portion of neck 404.

FIG. 4 illustrates an orthogonal side view of an exemplary Faucet 400, possessing a short, linear neck 404 assembly. Neck 404 depicts a single proximity sensor 410 and associated service light 414 are both mounted onto the front, top portion of neck 404; and soap outlet 408 affixed onto the bottom of neck 404 between base 406 and spout 402. Unlike the aforementioned embodiments, Faucet 400 depicts soap outlet 408 at a substantially distant location from proximity sensor 410 (opposite sides of neck 404). This is due, in part, to the compact faucet structure of this particular embodiment. Because of the relatively close proximity of handle 412 to proximity sensor 410, additional design considerations are considered in order to reduce/eliminate accidental activations producing wasted soap deliveries. An exemplary design consideration is directed to proximity sensor 410 having a relatively short detection zone in order to distinguish between handle manipulation and an activation event directed to proximity sensor 410. An additional design consideration is directed to the system's control logic (managed by a control module), wherein the flow of water 518 (depicted in FIG. 5) must be initiated before the proximity sensor 410 is capable of detecting any activation events. Yet another additional design consideration, also directed to the system's control logic (managed by a control module), wherein a handle 412 control signal in cooperation with the system's control logic, requires a user to engage and release handle 412 before proximity sensor 410 is permitted to generate any activation signals (initiating soap deliveries).

Figure 5:
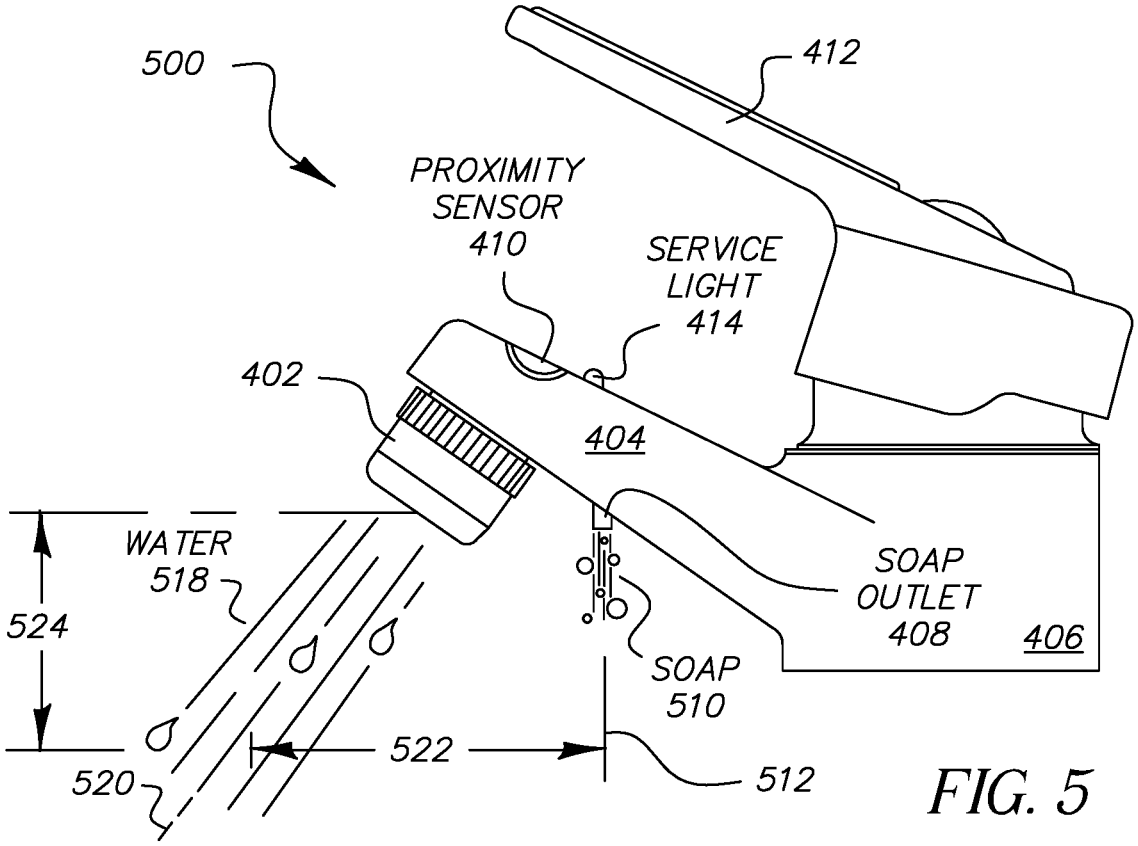
FIG. 5 illustrates an orthogonal side view of an exemplary faucet 500, possessing a short, linear neck assembly depicted in FIG. 4. The Figure further depicts trajectories of water 518 and soap 510 departing from spout 402 and soap outlet 408, respectively.
Figure 6:
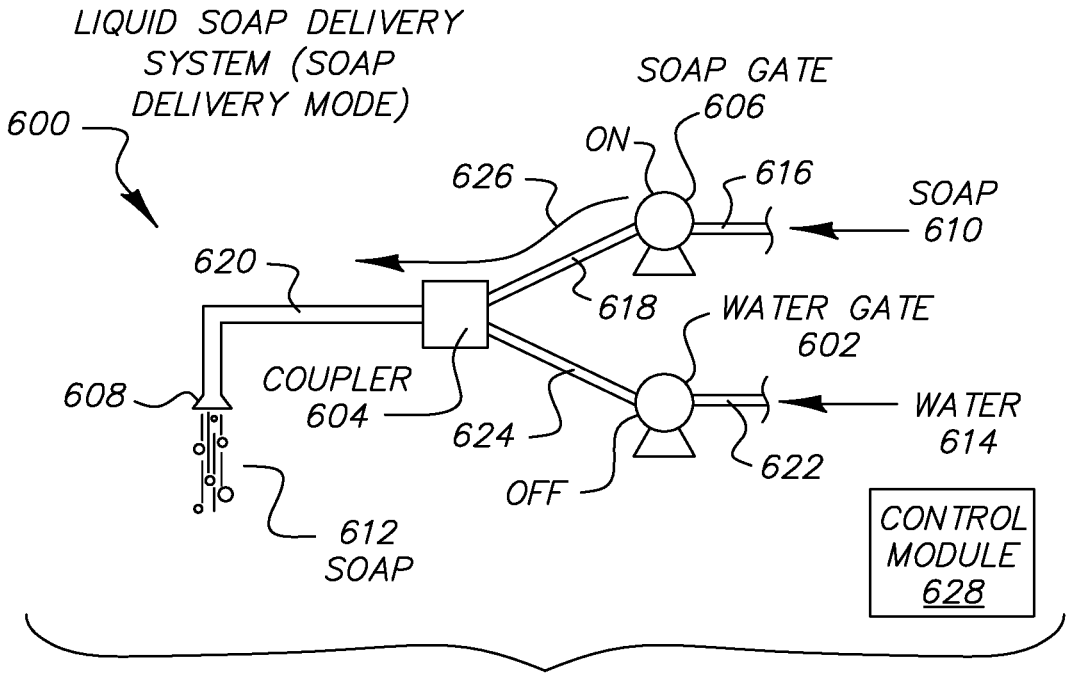
FIG. 6 illustrates a graphical system schematic of soap delivery system 600. Soap delivery system 600 depicts the system in soap delivery mode.

FIG. 5 illustrates active Faucet 500 delivering water 518 and soap 510. Faucet 500 is a depiction of Faucet 400 embodiment of FIG. 4 in the activated state. Directed to relatively compact faucet designs, Faucet 500 demonstrates a configuration to virtually eliminate the opportunity for cross contamination between soap 510 and water 518 without the need to substantially separate water spout 102 and soap outlet 108. Water spout 402 delivers water 518 according to the path depicted by water trajectory 520, and soap outlet 408 delivers soap 510 according to the path depicted by soap free-fall trajectory 512. Water spout 402 is angled away from the true vertical orientation (water free-fall trajectory 120 depicted in FIG. 1). The angled away feature associated with water spout 402, produces a water trajectory 520 that includes a horizontal (X-axis) component in its vector water trajectory 520. This produces a trajectory separation length 522, between soap free-fall trajectory 512 and water trajectory 520 at spacing 524 below spout 402. The coordinates at spacing 524 below spout 402 is estimated to be a typical working location for hand washing, and the like; at this typical working location there exists a trajectory separation length 522 between soap free-fall trajectory 512 and water trajectory 520. The trajectory separation length 522 at this working location is selected to virtually eliminate the opportunity for cross contamination between soap 510 and water 518. FIG. 6 illustrates a graphical system schematic of soap delivery system 600 having a water flush or water purge mode for purging soap 610 from soap delivery line 620 including soap outlet 608. The system is depicted in the soap delivery mode, where water gate 602 is in the OFF state (preventing any flow of water 614), and soap gate 606 is in the ON state (permitting flow of soap 610). Soap gate 606 in the activated or ON state, initiates soap delivery path 626, wherein soap 610 is pumped from soap storage tank via soap feed line 616 through soap gate output line 618 into coupler 604, then proceeding to soap delivery line 620 and soap outlet 608; wherein a user receives a delivery of soap 612. Coupler 604 combines the soap gate output line 618 and water gate output line 624 into a single soap delivery line 620.

Soap gate 606 contains the necessary and preferred subsystems to produce a safe reliable soap delivery (soap 612 delivery through soap outlet 608). Subsystems may include a pump, check-valve, flow valve, or any combination thereof, depending on the specifics of the installation, system design, and the like. The pump is an electrically powered device controlled by a pump control signal managed by control module 628. The flow valve or solenoid valve is an electrically powered valve having an electromechanical configuration and functions to control soap 610 flow through the valve; the state of the solenoid valve is determined by a valve control signal managed by control module 628. The check-valve provides a means to prevent back or reverse flow of a fluid, often to protect the fluid source (soap storage tank) from contamination. In the present embodiment, control module 628 provides the means for electrically controlling all components contained within soap gate 606 and water gate 602. For example, a solenoid valve contained within soap gate 606 (integrated onto a portion of soap delivery line) is regulated by control module 628. Exemplary functions managed by control module 628, includes soap dispensing duration (time), soap delivery initiation point in time—which is determined by a user performing an activation event. Activation events are deciphered by control module 628 via a sensor system, resulting in the production a one or more activation signals for activating the electrically controllable system components. For example, activating soap gate 606 electrical components for producing a soap 612 delivery to a user.

Figure 7:
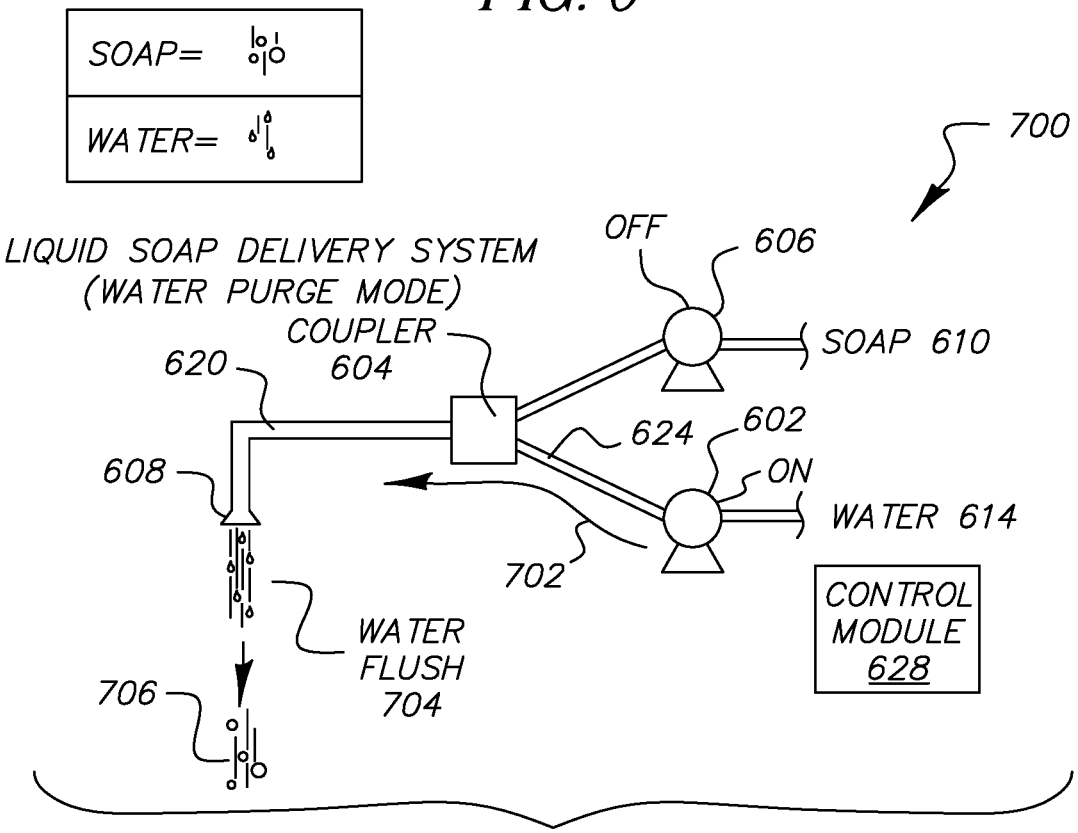
FIG. 7 illustrates a graphical system schematic of soap delivery system 700. Soap delivery system 700 depicts the system in a water purge mode.

Again referring to FIG. 6, water gate 602 contains the necessary and preferred subsystems to produce water flush 704 (depicted in FIG. 7). Subsystems may include a pump, check-valve, flow valve, or any combination thereof, depending on the specifics of the installation and system. The pump is an electrically powered device controlled by a pump control signal managed by control module 628. The flow valve or solenoid valve is an electromechanically operated valve that is also an electrically powered and controlled device, fluid (water 614) flow through the valve (the valve's on state) is determined by a valve control signal managed by control module 628.

It is understood that the final component composition soap gate 606 as well as water gate 602 are dependent on a variety of design factors. For example, a system that utilizes a pressurized soap storage tank will not require a pump. In this circumstance, fluid flow control is managed via the solenoid valve and check valve since the soap is self-propelled. Similarly, the use of a separate check valve will not be required if such a check valve function is integrated within the solenoid valve. Likewise, a pump will not be required if water 614 is pressurized (e.g. municipal tap water). Environments without continuous pressurized water service (e.g. boat, RV or recreational vehicle, or the like), are best served by systems that include a dedicated pump.

FIG. 7 illustrates a graphical system schematic of soap delivery system 700. System 700 is a depiction of soap delivery system 600 of FIG. 6 in the water flush or water purge mode. Again, the water flush or water purge mode functions to purge soap 610 from soap delivery line 620 and attached soap outlet 608. The water flush mode is characterized by water gate 602 in the ON state (permitting flow of water 614), and soap gate 606 is in the OFF state (preventing flow of soap 610). Water gate 602 in the activated or ON state, which initiates water flush path 702, wherein water 614 (pressurized water source) flows through water feed line 622 into water gate 602 entering water gate output line 624 into coupler 604. From the point in time where water 614 exits coupler 604, the purging of the residual soap 706 commences. Residual soap 706 consists of soap 610 remaining in soap delivery line 620 and soap outlet 608 after control module 628 terminates the delivery of soap 610 to the user. Again, the water flush 704 helps prevent soap 610 buildup in soap delivery line 620 and soap outlet 608, a well-known cause of soap delivery line type clogs and flow restrictions.

Water flush 704 is initiated by control module 628 and follows a predetermined flush plan following a delivery of soap 612 to a user (a soap delivery). For example, control module 628, after terminating a delivery of soap 612 to the user, initiates water flush 704 having duration of a few seconds. Another possibility—control module 628 will periodically initiate water flush 704 according to a predetermined schedule (e.g. every hour, every day, or the like). Yet another possibility—control module 628 will initiate a single water flush 704 for every predetermined user requests for soap 612. In certain embodiments, predetermined flush plan will be user adjustable via a user interface associated with control module 628. It is understood that certain embodiments of control module 628 can include an advanced time keeping device (e.g. clock, timer, or the like) that is capable of keeping track of seconds, minutes, hours, days, weeks, and the like.

Figure 8:
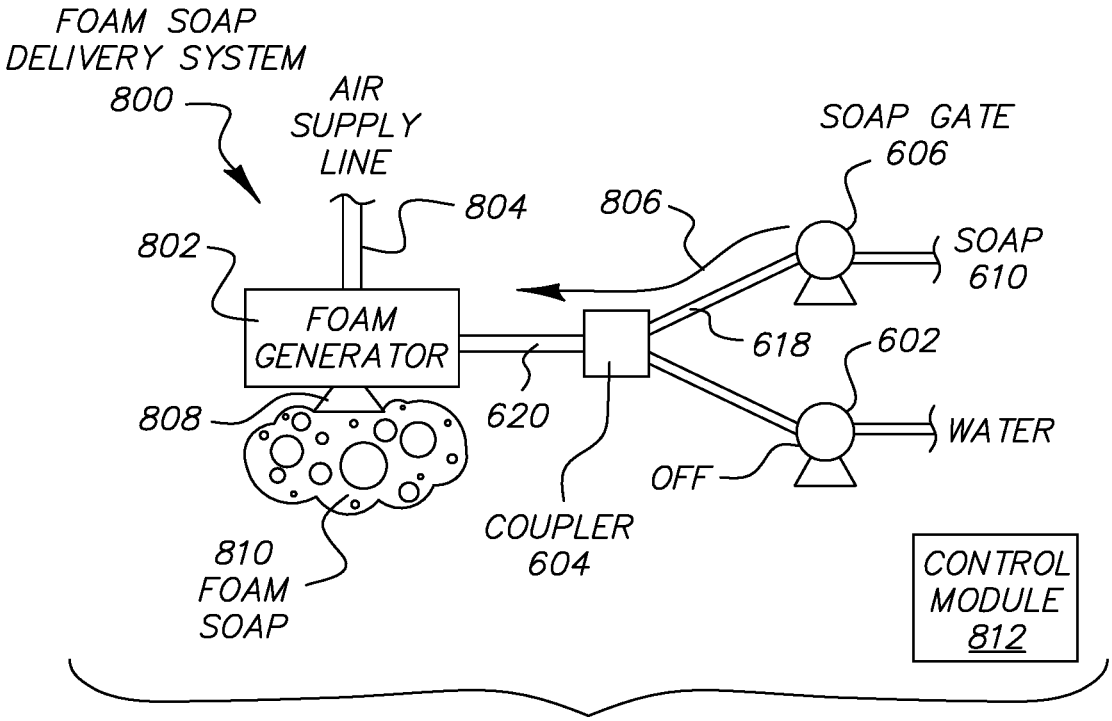
FIG. 8 illustrates a graphical system schematic of foam soap delivery system 800. Foam soap delivery system 800 depicts the system in soap delivery mode.

FIG. 8 illustrates a graphical system schematic of foam soap delivery system 800 including a water flush or water purge mode for purging soap 610 and foam soap 810 (foam version of soap 610) from soap delivery line 620, foam soap generator 802, and foam soap outlet 808. Foam soap delivery system 800 is depicted in soap delivery mode. The fundamental principles directed to Foam soap delivery system 800 are similar to soap delivery system 600 (in soap delivery mode) of FIG. 6, with the exception of the introduction of a means to generate foam soap (introduction of air into liquid soap) incorporated therein.

With soap delivery path 806 activated (soap delivery mode ON), soap gate 606 in the activated or ON state, initiates the transmission of soap 610 from soap storage tank via soap feed line 616 through soap gate output line 618 into coupler 604, then proceeding to soap delivery line 620 and into foam generator 802, with the assistance of air supply line 804 cooperating with foam generator 802, foam soap 810 exits from foam soap outlet 808.

Figure 9:
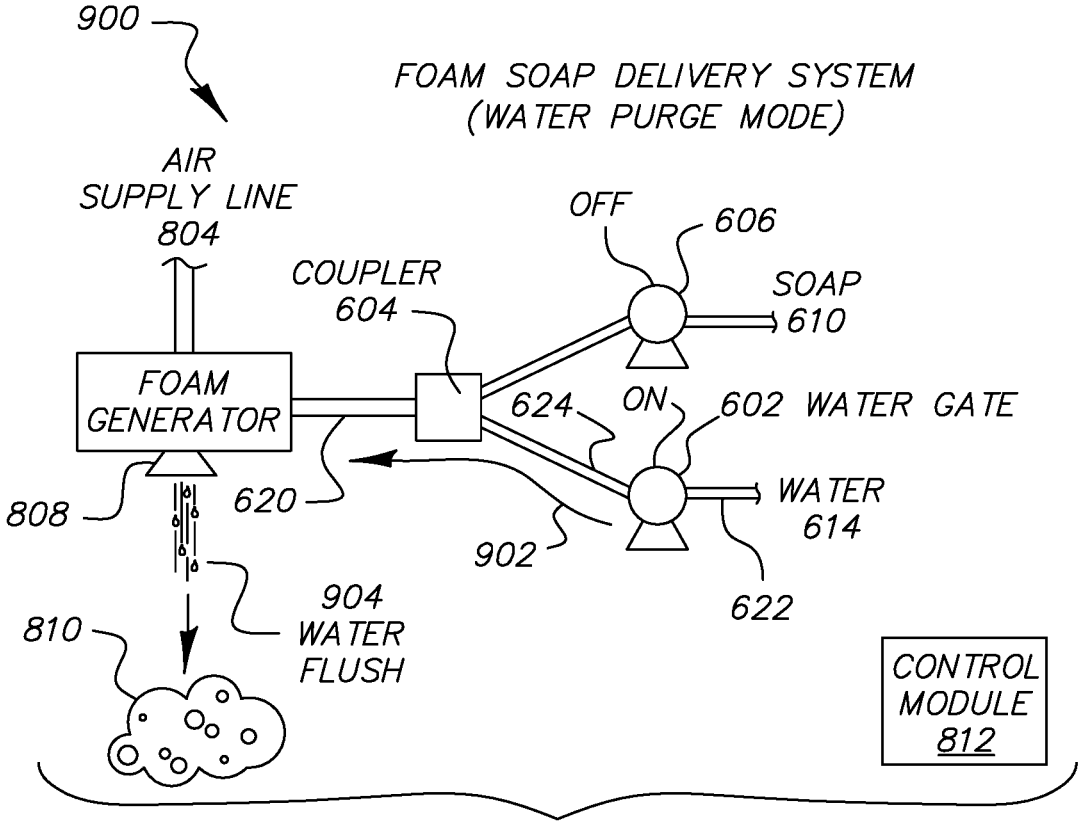
FIG. 9 illustrates a graphical system schematic of foam soap delivery system 900. Foam soap delivery system 900 depicts the system in a water purge mode.

FIG. 9 illustrates a graphical system schematic of foam soap delivery system 900, wherein the illustration is depiction of system 800 depicted in FIG. 8 in water flush or water purge mode. The water flush or soap purge mode functions to purge soap 610 from soap delivery line 620 and foam soap 810 from foam generator 802 and foam soap outlet 808. The water flush mode is characterized by water gate 602 switching to the ON state (permitting flow of water 614), while soap gate 606 is in the OFF state (preventing any further flow of soap 610). Water flush path 902 commences when water gate 602 is activated or switched to the ON state, which initiates water 614 (pressurized water source) flow through water feed line 622 into water gate 602 entering water gate output line 624 which feed into coupler 604. From the point in time where water 614 exits coupler 604, the purging of the residual soap 810 commences. Residual soap 810 consists of soap 610 remaining in soap delivery line 620 and foam soap residing in foam soap generator 802 and foam soap outlet 808, after a foam soap delivery is terminated by control module 628.

Water flush 904 helps prevent soap 610 and foam soap 810 buildup in soap delivery line 620, foam soap generator 802 and foam soap outlet 808. Soap buildup is a well-known cause of soap delivery line type clogs and flow restrictions. Often, foam soap generators incorporate a fine screen mesh, or the like, which have an even greater propensity to clog over tubes. In such situations, water flush 904 serves to help mitigate a long felt need in the foam soap dispensing arts (anti-clogging). In other embodiments, water flush 904 can be further enhanced by introducing air into foam soap generator 802 via air supply line 804. Examples of foam soap generating systems are disclosed in U.S. Pat. No. 7,458,523 (Hyslop) and U.S. Pat. No. 7,819,289 (Willis) both incorporated by reference herein in their entirety.

Figure 10:
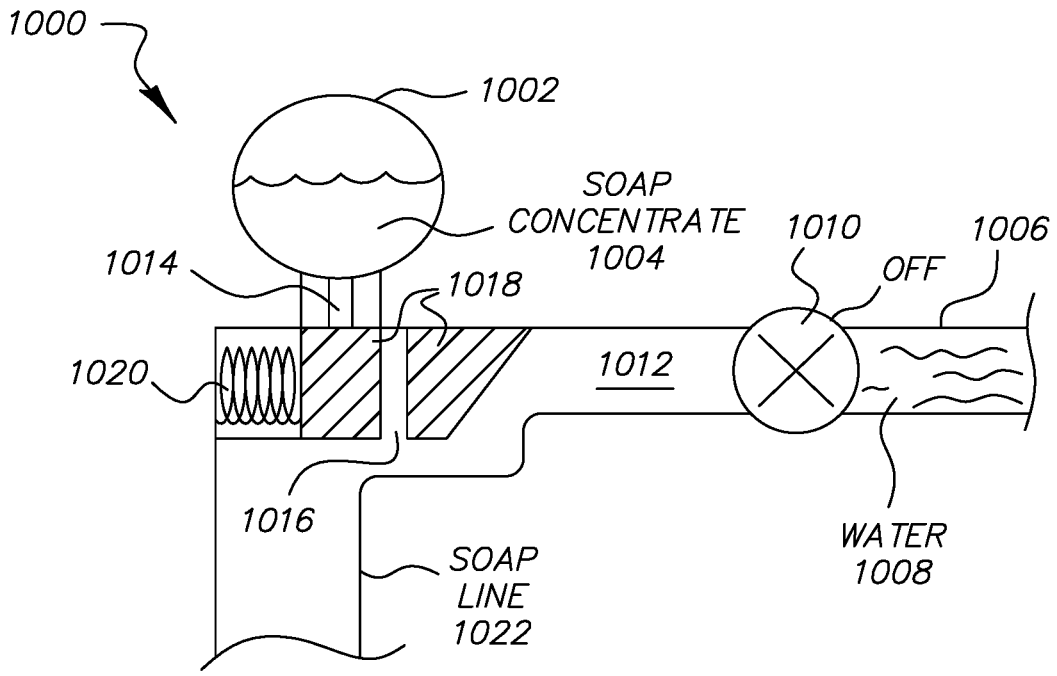
FIG. 10 presents a sectional orthogonal side view of an exemplary soap delivery system 1000, depicting a means for delivering soap utilizing water pressure. The Figure depicts the system in the off state (i.e. the system is not delivering soap).

FIG. 10 illustrates a sectional orthogonal side view of an exemplary soap delivery system 1000 in the OFF state. Soap delivery system 1000 depicts an apparatus for transporting soap to a user that does not require a dedicated mechanical or electromechanical pump; instead, the energy contained within pressurized water 1008 powers the transportation of soap concentrate 1004 (contained in soap storage tank 1002) through soap delivery line 1022. Soap delivery system 1000 provides an exemplary apparatus that requires minimal electrical power. Such a setup provides advantages when the faucet system of the present invention is configured to a specific embodiment that is powered by battery, solar cells, water-line turbine, or the like. Additional benefits from the setup of soap delivery system 1000, includes extending backup battery life, reducing power generator current draw, and the like. Such energy saving advantages will prove valuable in times of power failure or when the system of the present invention is installed in an environment where continuous is utility power is intermittent (e.g. boat, RV, mobile home, or the like).

Soap delivery system 1000 embodiment (in the OFF state) is comprised of water feed line 1006 containing pressurized water 1008, water feed line 1006 is connected to input (right) portion of valve gate 1010 (depicted in the closed state), the output portion of valve gate 1010 is connected to valve input line 1012. Control valve 1018 is a sliding member that has an open state (permits soap concentrate 1004 flow) and a closed state (soap concentrate 1004 flow is blocked). Control spring 1020 (uncompressed condition) urges control valve 1018 into its normally in the closed state; accordingly, tank delivery channel 1014 is misaligned with respect to valve delivery channel 1016 thereby blocking the free flow of soap concentrate 1004.

Figure 11:
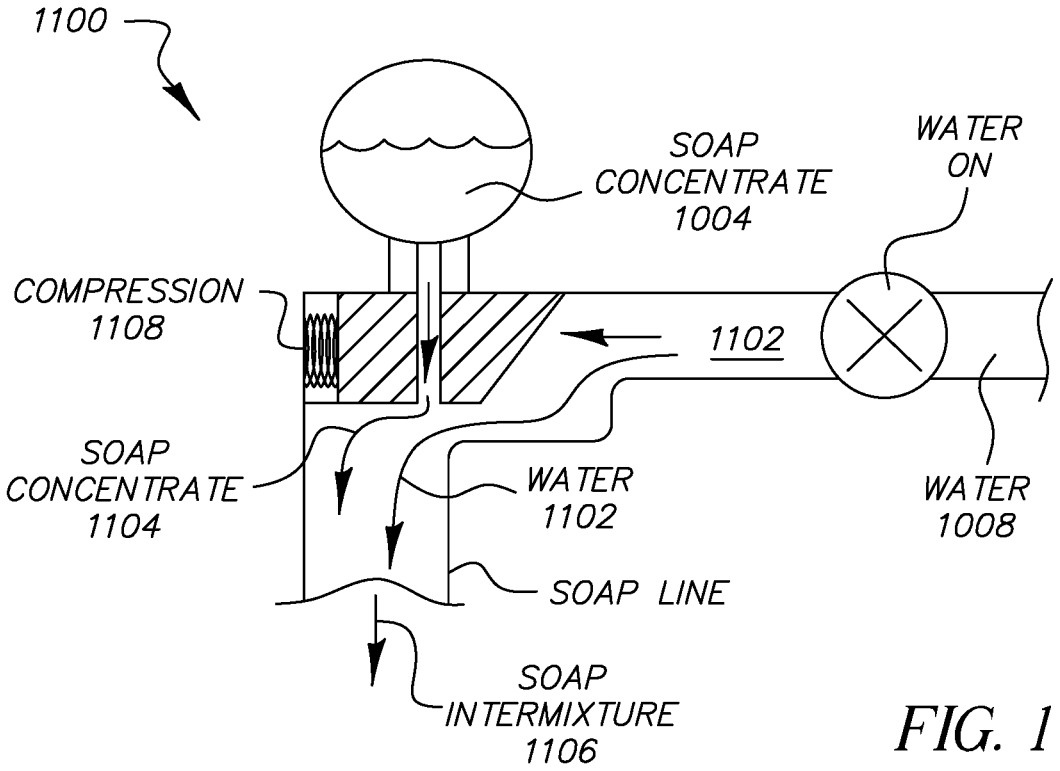
FIG. 11 presents a sectional orthogonal side view of an exemplary soap delivery system 1100, depicting a means for delivering soap utilizing water pressure. The Figure depicts soap delivery system 1000 of FIG. 10, wherein the system in the on state (i.e. the system is delivering soap).

FIG. 11 illustrates a sectional orthogonal side view of an exemplary soap delivery system 1100 in the ON state. When normally closed valve gate 1010 is activated by a user, it allows pressurized water 1008 from water feed line 1006 to pass through and enter valve input line 1012 where it engages control valve 1018; the pressure from water 1008 urges control valve 1018 to the left, overpowering control spring 1108 and placing it in compression. Consequently, aligning tank delivery channel 1014 with respect to valve delivery channel 1016 so to permit the flow of soap concentrate 1004 into soap line 1022. At this juncture, soap concentrate flow 1104 combines with water flow 1102 resulting in soap intermixture flow 1106.

Soap intermixture flow 1106 is a soap solution of predetermined concentration, dictated by a number of factors, including the strength of soap concentrate 1004, the soap flow rate from valve delivery channel 1016, the volume and flow rate of water flow 1102, and the like. It is understood that there are a multitude of system variations possible that can achieve the same purpose. An advantage directed to the present system is directed to the use of soap concentrate 1004. Because soap concentrate 1004 requires the addition of water to create a soap concentration of normal strength, the refill frequency associated with soap storage tank 1002 will decrease; in another respect, costs associated with shipping, storage, and production of a soap concentrate are expected to be less expensive than its normal concentration counterpart.

Figure 12:
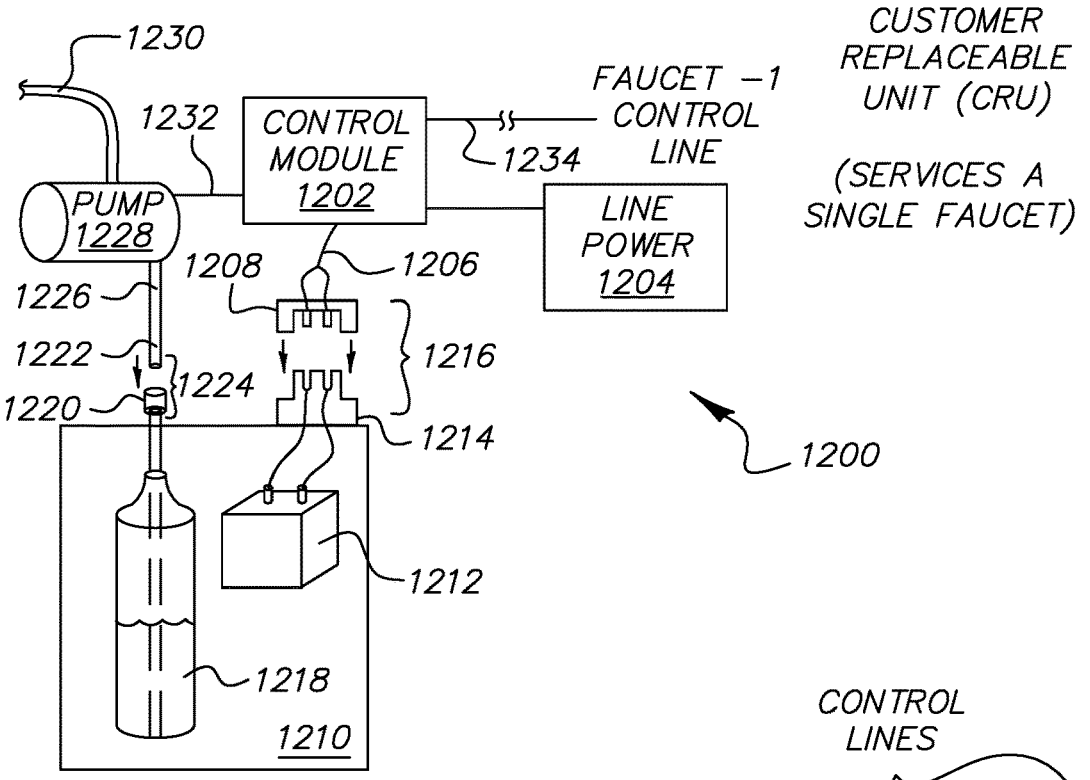
FIG. 12 illustrates a graphical system schematic of customer replaceable unit system 1200, servicing a single faucet. Exemplary customer replaceable unit system 1200 depicts customer replaceable unit 1210 comprising soap storage tank 1218 and battery 1212.

FIG. 12 illustrates a graphical system schematic of customer replaceable unit system 1200, servicing a single faucet (faucet-1). Exemplary customer replaceable unit system 1200, depicts customer replaceable unit 1210 (CRU 1210) comprising soap storage tank 1218 and battery 1212. The most basic CRU 1210 type embodiments will contain at least soap storage tank 1218, whereas more comprehensive embodiments will contain battery 1212. Battery 1212 can function as the primary source of electrical power, or as a backup power source called into service only during times of main power failure (e.g. supplied by a utility company). The aforementioned discussion also applies to customer replaceable unit system 1300 of FIG. 13.

Again, referring to FIG. 12, customer replaceable unit 1210 (CRU 1210) is comprised of soap storage tank 1218 and battery 1212 organized within a convenient, easy to manipulate package or assembly. CRU 1210 enables a user or a maintenance individual to quickly replace the consumables associated with customer replaceable unit system 1200. Both battery quick connect system 1216 and soap quick connect system 1224 form an integral part of the user-friendly construction of CRU 1210, enabling fast and easy system maintenance. Battery quick connect system 1216 is comprised of battery connector 1214 (attached to CRU 1210) which is removably attachable to removable connector 1208—which is electrically connected to control module 1202 via battery cable 1206. Similarly, soap quick connect system 1224 is comprised of soap output post 1220 (attached to CRU 1210) which is removably attachable to removable fitting 1222—which is fluidly connected to pump 1228 via pump input line 1226.

In this embodiment, control module 1202 receives utility power from line power 1204; this power source can be used to operate all components requiring electrical power in the present invention, and/or maintain a backup battery 1212 or the like, at full charge until required. Control module 1202 is electrically connected to faucet-1 via faucet control signal/power cable 1234, providing services including communicating with sensor system, operating service light, and the like. Control module 1202 is also electrically connected to pump 1228 via pump control cable 1232, which provides pump control signals for managing predetermined soap delivery behavior directed to pump output line 1230.

Figure 13:
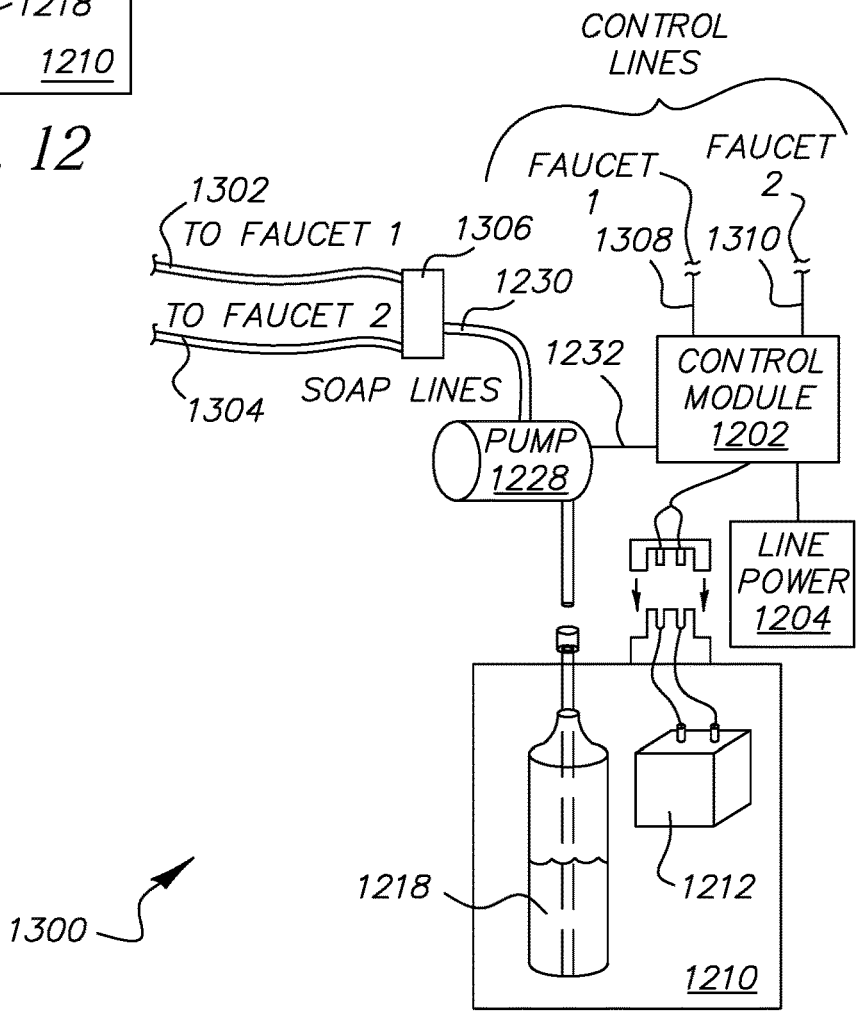
FIG. 13 illustrates a graphical system schematic of customer replaceable unit system 1300, servicing a faucet network (i.e. more than one faucet). Exemplary customer replaceable unit system 1200 depicts customer replaceable unit 1210 comprising soap storage tank 1218 and battery 1212 servicing a faucet network.

FIG. 13 illustrates a graphical system schematic of customer replaceable unit system 1300, servicing more than one faucet or a faucet network (e.g. faucet-1, faucet-2). The discussion directed to the operation of system 1300 is similar to that of aforementioned system 1200 with a few modifications. The following is a review of the modifications or differences disseminated into the constituent parts for further discussion. Soap storage tank 1218 and battery 1212 comprising customer replaceable unit 1210 (CRU 1210) are illustrated to service a faucet network (e.g. faucet-1, faucet-2). Pump output line 1230 enters soap distribution manifold 1306 (providing a means for soap distribution). Exiting soap distribution manifold 1306 is faucet soap line 1302 (servicing faucet-1), and faucet soap line 1304 (servicing faucet-2). Control module 1202 is electrically connected to faucet-1 via faucet control signal/power cable 1302, and faucet-2 via faucet control signal/power cable 1304. In summary, removably attachable CRU 1210, in cooperation with supporting components (e.g. pump 1228, control module 1202) is configured to fully support faucet-1, faucet-2, or any combination thereof. Servicing faucet-1 is signal control cable 1308, and servicing faucet-2 is faucet signal control cable 1310.

Figure 14:
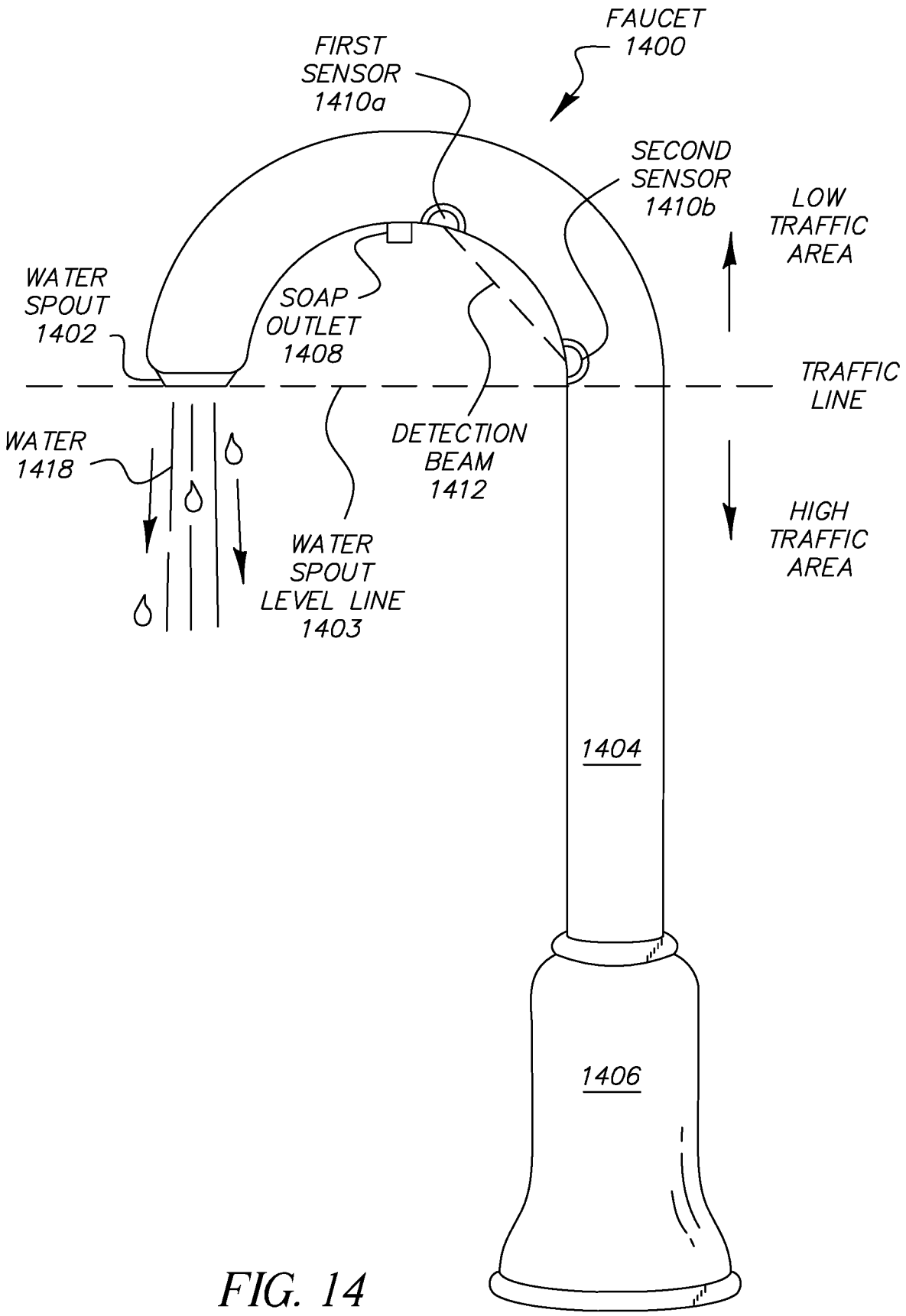
FIG. 14 illustrates an orthogonal side view of an exemplary faucet 1400 possessing an elongated arch neck assembly depicting a first sensor 1410*a* and second sensor 1410*b*, both disposed above water spout level line 1403 and mounted onto the rear, inner portion of neck 1404. The detection beam 1412 for soap delivery is disposed on the bottom portion of neck 1404, above the water spout level line 1403.

FIG. 14 illustrates an orthogonal side view of exemplary faucet 1400. Faucet 1400 includes an elongated neck 1404 assembly, having a standard arch type geometry. Faucet 1400 includes soap outlet 1408 affixed to the bottom side of mediate portion of neck 1404, located between base 1406 and spout 1402. The mediate portion includes an arch wherein, by way of example, but not limitation, a soap outlet 1408 affixed to the point of inflection corresponding to the bottom portion of the arch.

Faucet 1400 includes a beam-break sensor configuration for controlling soap delivery. The beam-break sensor configuration utilizes first sensor 1410*a* and second sensor 1410*b*, both disposed above water spout level line 1403 and mounted onto the bottom of the rear-upper arch portion of neck 1404. The detection beam 1412 for soap delivery is correspondingly disposed on the bottom of the rear-upper arch portion of neck 1404 that is located in a low traffic area, i.e., above water spout level line 1403. The location of detection beam 1412 in this configuration yields an embodiment with some exceptional benefits. One benefit is that the typical faucet activity of a user has virtually no chance of inadvertently engaging detection beam 1412, since it's located in a low traffic area. Another benefit is directed to the narrow, distinct detection boundaries offered by detection beam 1412, coupled by the fast response time typically offered by beam-break sensor type configurations. The beam-break configuration will provide a user with a clear distinct activation area or location that enables the hand motion from the user or activation event to immediately initiate a soap delivery; unlike some proximity sensor configurations where the detection zone is not precisely defined. Detection zones that are not well defined (e.g., single sensor IR proximity type devices) can lead to accidental activations, and often force users to wave their hands in random fashion in the vicinity of the proximity sensor(s) in hopes of finding an acceptable gesture that qualifies as an activation event to trigger the sensor system.

Figure 15:
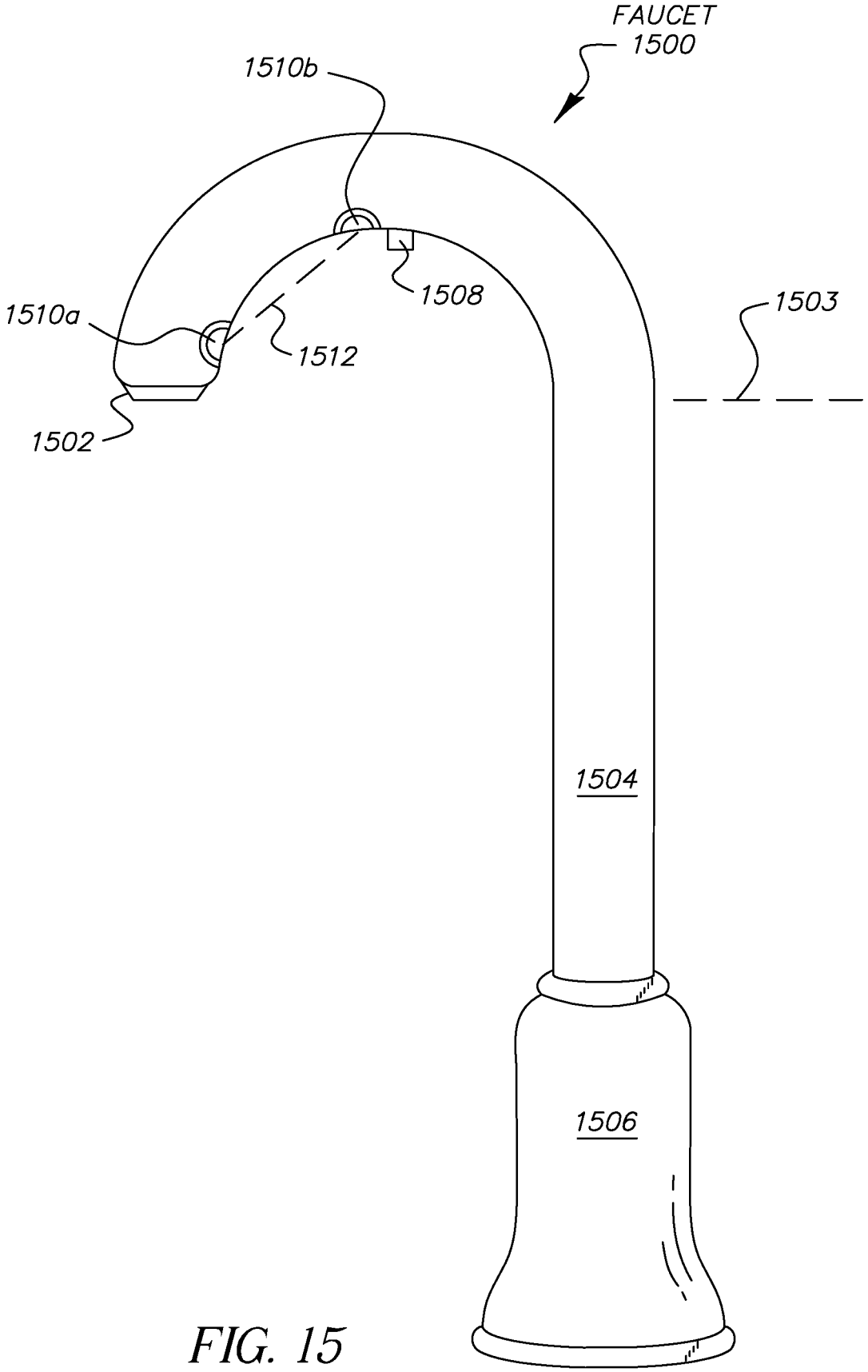
FIG. 15 illustrates an orthogonal side view of an exemplary faucet 1500 possessing an elongated arch neck assembly depicting a first sensor 1510*a* and second sensor 1510*b*, both disposed above water spout level line and mounted onto the front, inner portion of neck 1504. The detection beam 1512 for soap delivery is disposed on the bottom portion of neck 1504, above the water spout level line 1503.

FIG. 15 illustrates an orthogonal side view of exemplary faucet 1500. Faucet 1500 includes an elongated neck 1504 assembly, having a standard arch type geometry. Faucet 1500 includes soap outlet 1508 affixed to the bottom side of mediate portion of neck 1504, located between base 1506 and spout 1502. The mediate portion includes an arch wherein, by way of example, but not limitation, a soap outlet 1508 affixed to the point of inflection corresponding to the bottom portion of the arch.

Faucet 1500 includes a beam-break sensor configuration for controlling soap delivery. The beam-break sensor configuration utilizes first sensor 1510*a* and second sensor 1510*b*, both disposed in a low traffic area above water spout level line 1503 and mounted onto the bottom of the front-upper arch portion of neck 1504. The detection beam 1512 for soap delivery is correspondingly disposed on the bottom of the front-upper arch portion of neck 1504 that is again, located in a low traffic area, i.e., above water spout level line 1503. The location of detection beam 1512 in this configuration yields exceptional benefits as explained in the disclosed embodiments aforementioned, where the detection beam for soap delivery is completely located above the water spout level line (i.e., low traffic area).

Figure 16:
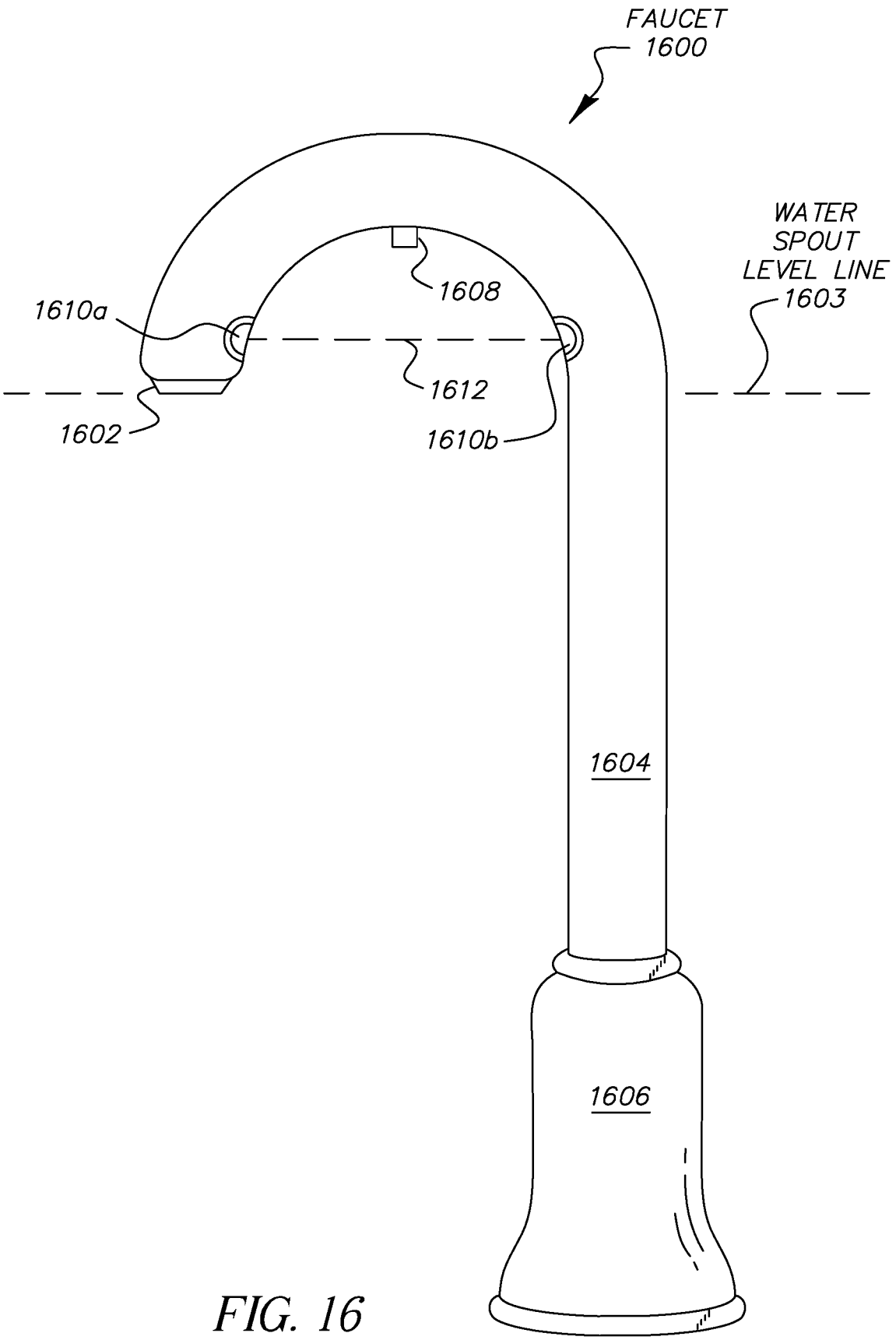
FIG. 16 illustrates an orthogonal side view of an exemplary faucet 1600 possessing an elongated arch neck assembly. The Figure depicts a first sensor 1610*a* and second sensor 1610*b*, both disposed above water spout level line 1603 and mounted onto the front and rear, inner portions of neck 1604. The detection beam 1612 for soap delivery is disposed on the bottom side of neck 1604, above the water spout level line.

FIG. 16 illustrates an orthogonal side view of exemplary faucet 1600. Faucet 1600 includes an elongated neck 1604 assembly, having a standard arch type geometry. Faucet 1600 includes soap outlet 1608 affixed to the bottom side of mediate portion of neck 1604, located between base 1606 and spout 1602. The mediate portion includes an arch wherein, by way of example, but not limitation, a soap outlet 1608 affixed to the point of inflection corresponding to the bottom portion of the arch.

Faucet 1600 includes a beam-break sensor configuration for controlling soap delivery. The beam-break sensor configuration utilizes first sensor 1610*a* and second sensor 1610*b*, both mounted onto the bottom, opposing sides of the arch located on the top portion of neck 1604. Both beam-break sensors and corresponding detection beam 1612 for soap delivery are disposed in a low traffic area above water spout level line 1603. Again, the location of detection beam 1612 in this configuration yields exceptional benefits as explained in the disclosed embodiments aforementioned, where the detection beam for soap delivery is located, in its entirety, above the water spout level line (i.e., low traffic area).

Figure 17:
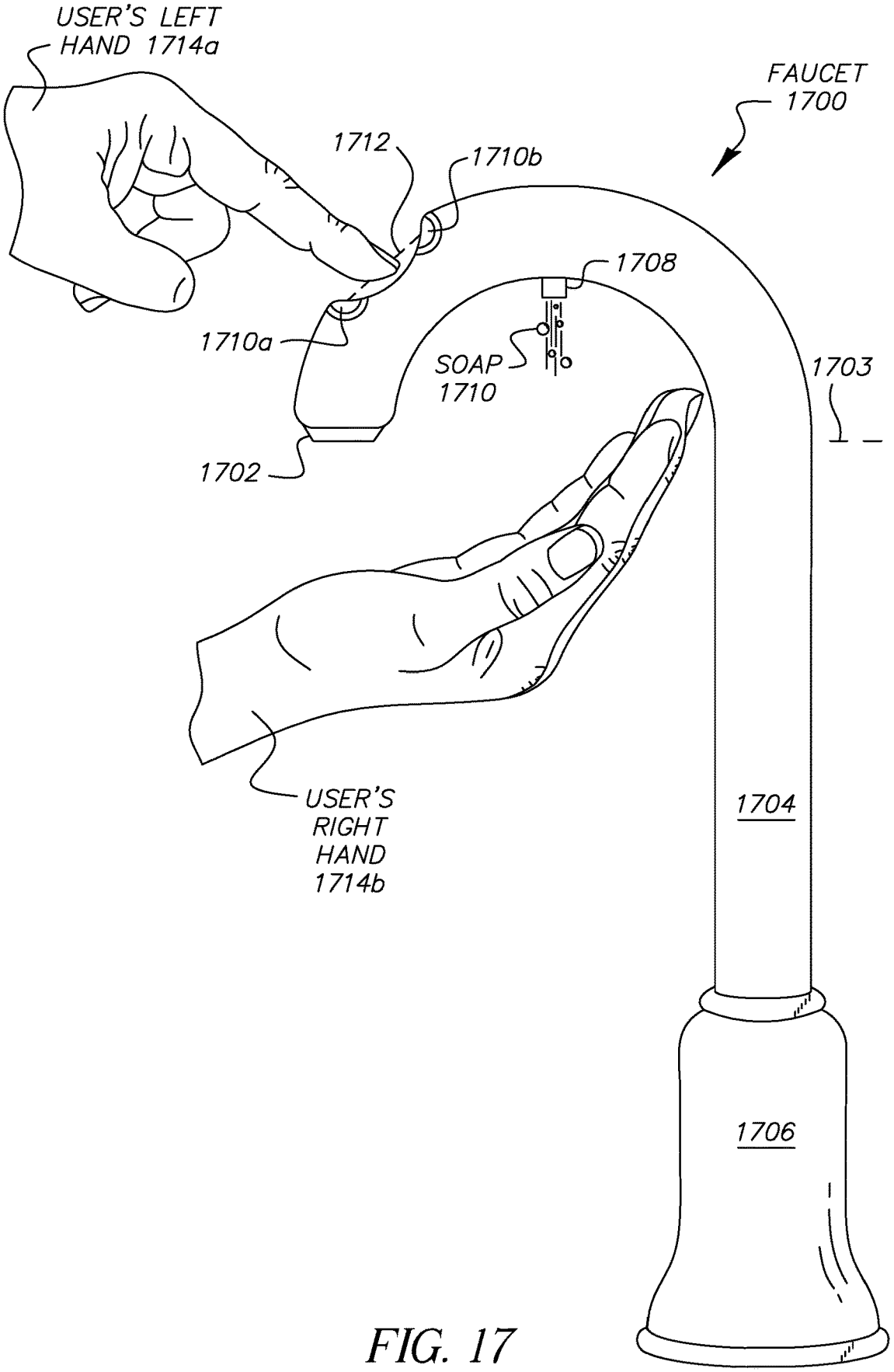
FIG. 17 illustrates an orthogonal side view of an exemplary faucet 1700 possessing an elongated arch neck assembly depicting a first sensor 1710*a* and second sensor 1710*b*, both disposed above water spout level line 1703, and mounted onto the front upper portion of neck 1704. The detection beam 1712 for soap delivery is disposed on the top, outer side of neck 1704, above the water spout level line 1703. The Figure additionally shows a portion of user's left hand 1714*a* engaging detection beam 1712 to activate soap 1710 delivery, and user's right hand 1714*b* receiving a delivery of soap 1710.

FIG. 17 illustrates an orthogonal side view of exemplary faucet 1700. Faucet 1700 includes an elongated neck 1704 assembly, having a standard arch type geometry. Faucet 1700 includes soap outlet 1708 affixed to the bottom side of mediate portion of neck 1704, located between base 1706 and spout 1702. The mediate portion includes an arch wherein, by way of example, but not limitation, a soap outlet 1708 affixed to the point of inflection corresponding to the bottom portion of the arch.

Faucet 1700 includes a beam-break sensor configuration for controlling soap delivery. The beam-break sensor configuration utilizes first sensor 1710*a* and second sensor 1710*b*, both disposed in a low traffic area above water spout level line 1703 and mounted onto the top of the front-upper arch portion of neck 1704. The detection beam 1712 for soap delivery is correspondingly generated by first sensor 1710*a* and second sensor 1710*b*, and located in a low traffic area, i.e., above water spout level line 1703. The location of detection beam 1712 in this configuration yields exceptional benefits as explained in the disclosed embodiments aforementioned, where the detection beam for soap delivery is completely located above the water spout level line (i.e., low traffic area). Additionally, FIG. 17 depicts a user's left hand 1714*a* engaging detection beam 1712 (breaking the beam) to initiate the delivery of soap 1710. The user's left hand 1714*a* is depicted in the low traffic area, located above water spout level line 1703. Since detection beam 1712 is located in the low traffic area, where stray arm and hand movements are substantially nonexistent, it is understood that the engagement with detection beam 1712, in such a location, is understood to be willful and intentional; and solely directed to requesting a soap delivery. Shown is user's left hand 1714*a* intentionally engaging detection beam 1712, resulting in delivery of soap 1710 into user's right hand 1714*b*.

Figure 18:
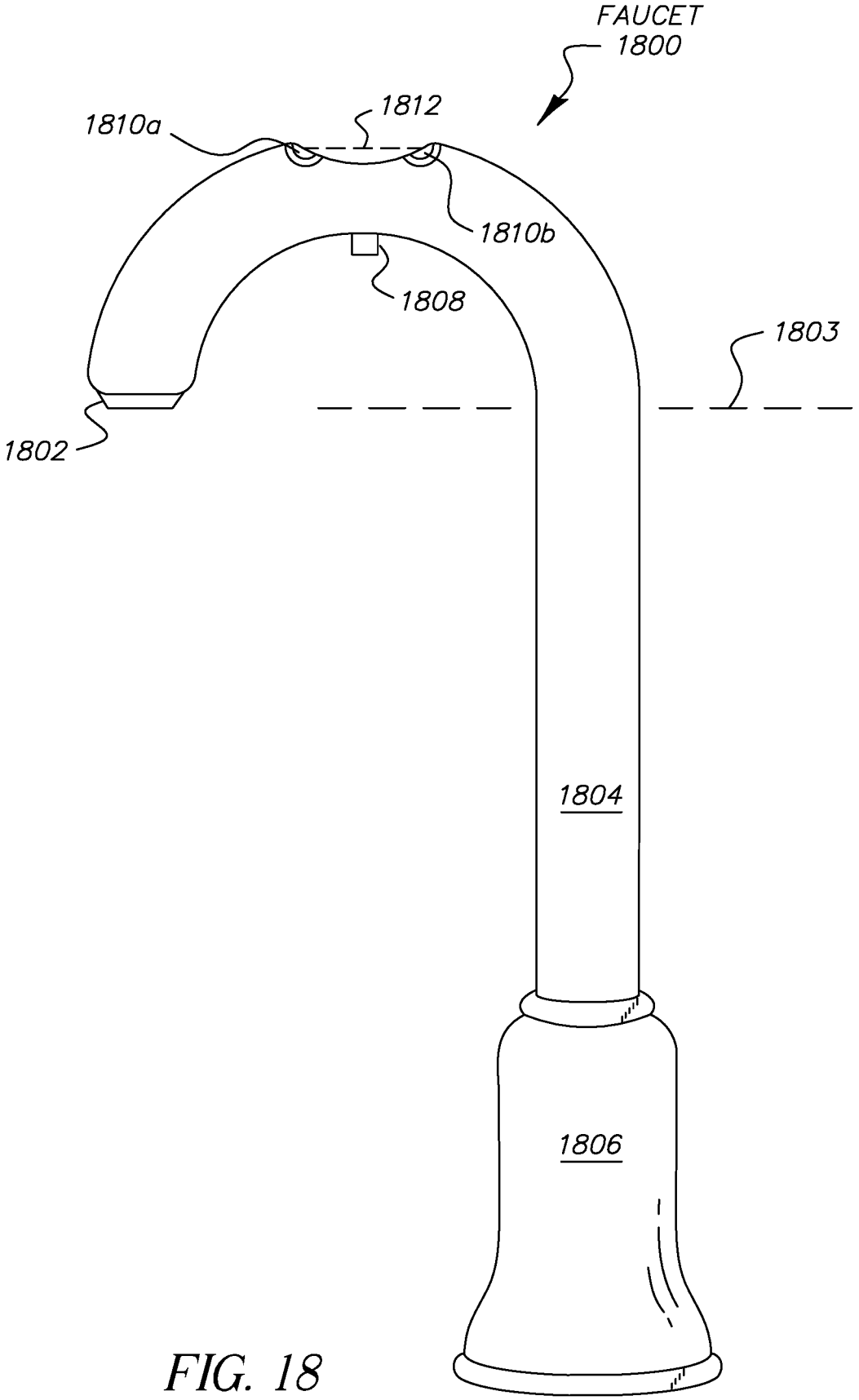
FIG. 18 illustrates an orthogonal side view of an exemplary faucet 1800 possessing an elongated arch neck assembly depicting a first sensor 1810*a* and second sensor 1810*b*, both disposed above water spout level line 1803, and mounted onto the approximate midpoint portion of neck 1804 on the top, outer side of neck 1804. The detection beam 1812, for soap delivery activation, is disposed on the top side of neck 1804, in its entirety, above the water spout level line 1803.

FIG. 18 illustrates an orthogonal side view of exemplary faucet 1800. Faucet 1800 includes an elongated neck 1804 assembly, having a standard arch type geometry. Faucet 1800 includes soap outlet 1808 affixed to the bottom side of mediate portion of neck 1804, located between base 1806 and spout 1802. The mediate portion includes an arch wherein, by way of example, but not limitation, a soap outlet 1808 affixed to the point of inflection corresponding to the bottom portion of the arch.

Faucet 1800 includes a beam-break sensor configuration for controlling soap delivery. The beam-break sensor configuration utilizes first sensor 1810*a* and second sensor 1810*b*, both disposed in a low traffic area above water spout level line 1803 and mounted onto the top of the mid-upper arch portion of neck 1804. The detection beam 1812 for soap delivery is correspondingly disposed on the top of the mid-upper arch portion of neck 1804 that located in a low traffic area, i.e., above water spout level line 1803. The location of detection beam 1812 in this configuration yields exceptional benefits as explained in the disclosed embodiments aforementioned, where the detection beam for soap delivery is completely located above the water spout level line (i.e., low traffic area).

Figure 19:
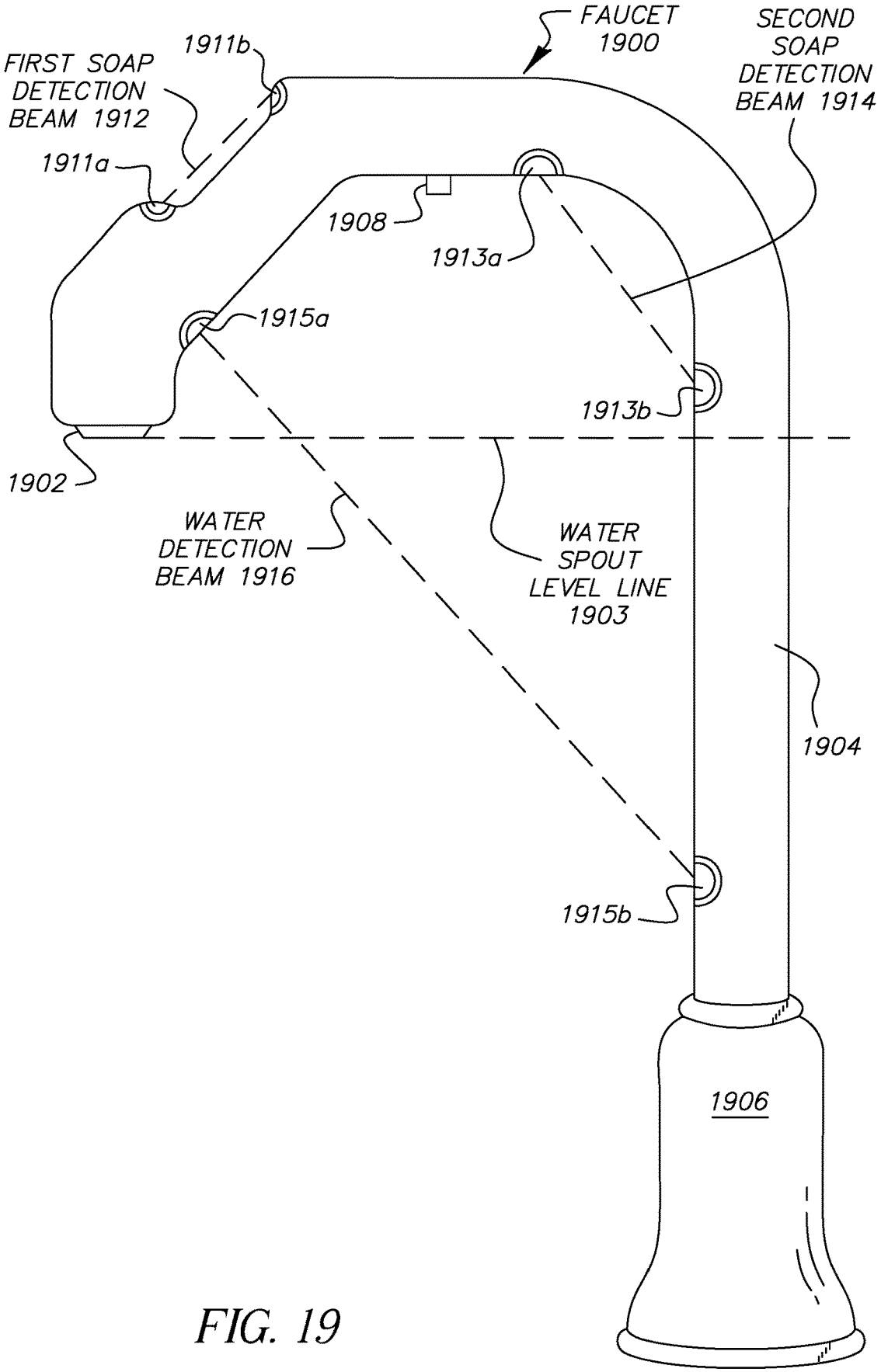
FIG. 19 illustrates an orthogonal side view of an exemplary faucet 1900 possessing an elongated arch neck assembly. The Figure depicts a first soap detection beam 1912 and second soap detection beam 1914, both soap delivery beams are disposed above water spout level line 1903. Detection beam 1912 is disposed on the front, outer portion of neck 1904 and detection beam 1914 is disposed on the rear, inner portion of neck 1904, thereby providing the user with improved convenience. Additionally, water detection beam 1916 is shown with a portion of its beam disposed below the water spout level line 1903 (the beam entering the high traffic area).

FIG. 19 illustrates an orthogonal side view of exemplary faucet 1900. Faucet 1900 includes an elongated neck 1904 assembly, sporting a sideways, capital letter "C" type geometry. Faucet 1900 includes soap outlet 1908 affixed to the bottom side of mediate portion of neck 1904, located between base 1906 and spout 1902. The mediate portion includes a soap outlet 1908 affixed to the bottom portion elongated neck 1904, pointed in a downward, vertical, orientation.

Faucet 1900 includes two beam-break sensor configurations for controlling soap delivery, and one beam-break sensor configuration for water delivery. The first beam-break sensor configuration utilizes first sensor 1911*a* and second sensor 1911*b*, for the generation of detection beam 1912, located on the top-front portion of elongated neck 1904. The second beam-break sensor configuration utilizes first sensor 1913*a* and second sensor 1913*b*, for the generation of detection beam 1914, located on the bottom-rear portion of elongated neck 1904. Both detection beams, for controlling soap delivery, 1912 and 1914 are disposed in a low traffic area above water spout level line 1903 to substantially reduce/eliminate accidentally soap delivery. The two detection beams 1912 and 1914 will yield greater convenience to a user, offering more than one location to initiate a soap delivery. For example, detection beam 1912 can be utilized when a user, with dry hands, requests a soap delivery to initiate hands washing; whereas detection beam 1914 can be more easily triggered by a user that is already in the process of washing and just requires additional soap. Additionally depicted in FIG. 19, is a beam-break sensor configuration for water delivery. The beam-break sensor configuration for water delivery utilizes first sensor 1915*a* and second sensor 1915*b*. First sensor 1915*a* is located in a low traffic area above water spout level line 1903 on the bottom, front-upper portion of elongated neck 1904; whereas the second sensor 1915*b* is located in a high traffic area below water spout level line 1903 just above base 1906. The locations of water initiation sensors 1915*a* and 1915*b* produce a water detection beam 1916 having a portion of the detection beam 1916 residing in the high traffic area (below water spout level line 1903) to substantially enable quick, straightforward, reliable water delivery.

What is claimed herein is:

1. A faucet system comprising:

a neck, comprising a plurality of delivery segments, configured from a substantially continuous structure, having an internal volume; said plurality of delivery segments are contiguously linked, further comprising a base portion for supporting said plurality of delivery segments, including a first delivery segment and a second delivery segment; said first delivery segment includes a water spout disposed thereon, configured to produce a water stream for the delivery of water; and said second delivery segment including a soap outlet disposed thereon, configured to produce a soap stream for the delivery of a soap;

a water passageway, contained within said internal volume, configured to provide a water flow path for said water stream through said water spout;

a means for initiating said water stream through said water spout;

at least one sensor for controlling a soap delivery disposed on said second delivery segment on said neck; each said sensor having a detection zone, wherein said zone is substantially parallel with said soap stream;

a soap delivery line, contained within said internal volume, fluidly connected to said soap spout, wherein a user receives a soap delivery of said soap dispensed within a soap delivery zone;

said soap outlet and said water spout are configured to provide a trajectory separation length of at least one inch, wherein said trajectory separation length is approximately the distance between said water spout, configured to produce said water stream; and said soap outlet, configured to produce a soap stream; each said stream possesses its own distinct receiving region to virtually eliminate the opportunity for cross contamination;

an electrically controlled means for controlling said soap delivery, integrated onto a portion of said soap delivery line, wherein said electrically controlled means for controlling said soap delivery is regulated by a control module, said control module manages a soap dispensing duration, and a soap delivery initiation point in time, determined by a user's hand, executing an activation event that produces an activation signal, initiated by said at least one sensor, enabling a user the means for initiating said soap delivery and receiving said soap delivery from said activation event.

2. The faucet system of claim 1, wherein said means for initiating said water stream through said water spout, further comprising at least one sensor for controlling a water delivery mounted on said first delivery segment.

3. The faucet system of claim 1, further comprising a water delivery line disposed within said internal volume of said neck, thereby providing a dedicated water passageway enabling said water stream through said spout.

4. The faucet system of claim 1, further comprising a service light affixed to at least one delivery segment to provide a communication to said user, wherein said communication is selected from the group consisting of guiding said user to said at least one delivery segment and providing a system diagnostic.

5. The faucet system of claim 4, wherein said service light affixed to at least one delivery segment is selected from the group consisting of an LED, an LED capable of emitting more than one color light, and an illumination ring.

6. The faucet system of claim 1, further comprising said second delivery segment having a top and a bottom, wherein said soap outlet is located on said bottom of said second delivery segment.

7. The faucet system of claim 6, further comprising said at least one sensor for controlling a soap delivery mounted on said second delivery segment; wherein each said sensor having a detection zone, is configured such that said detection zone is substantially coterminous with said soap stream.

8. The faucet system of claim 1, further comprising said soap delivery line comprising a means for delivering said soap, wherein said soap is selected from the group consisting of a foam soap and a liquid soap.

9. The faucet system of claim 1, further comprising said trajectory separation length of at least two inches, wherein said trajectory separation length is approximately the distance between said water spout, configured to produce said water stream and said soap outlet, configured to produce a soap stream.

10. The faucet system of claim 1, further comprising a removably attachable customer replaceable cartridge, comprising a soap storage tank fluidly adapted to releasably attach to said soap delivery line, wherein configuration of said soap delivery line is selected from the group consisting of a single faucet and a faucet network.

11. A method for initiating a soap delivery and receiving a soap delivery from a faucet system, said faucet system comprising:

a neck, comprising a plurality of delivery sections, configured from a substantially continuous structure, having an internal volume; said plurality of delivery sections are contiguously linked, further comprising at least one base for supporting said plurality of delivery sections, said elongated neck comprising a first delivery section, and a second delivery section, said first delivery section includes a water spout disposed thereon, configured to produce a water stream for the delivery of water; and said second delivery section including a soap outlet disposed thereon, configured to produce a soap stream for the delivery of a soap;

a water passageway, contained within said internal volume, configured to provide a water flow path for said water stream through said water spout;

a means for initiating said water stream through said water spout;

at least one sensor for controlling a soap delivery disposed on said second delivery section on said neck; each said sensor having a detection zone, wherein said detection zone is substantially parallel with said soap stream, such that a user's hand can substantially simultaneously engage with said detection zone and receive said soap delivery;

a soap delivery line, contained within said internal volume, fluidly connected to said soap spout, wherein a user receives a soap delivery of said soap dispensed within a soap delivery zone;

said soap outlet and said water spout are configured to provide a trajectory separation length of at least one inch, wherein said trajectory separation length is approximately the distance between said water spout, configured to produce said water stream and said soap outlet, configured to produce a soap stream; wherein each said stream possesses its own distinct receiving region to virtually eliminate the opportunity for cross contamination;

an electrically controlled means for controlling soap delivery parameters, said soap delivery parameters include an activation of said soap delivery and controlling a soap delivery duration; said electrically controlled means is integrated onto a portion of said soap delivery line, and is regulated by a control module, said control module manages said soap delivery parameters, wherein said user's hand, executing an activation event, produces at least one activation signal, initiated by said at least one sensor, enabling said user the means for controlling at least one said soap delivery parameters, said method comprising:

(a) entering said detection zone, wherein said soap delivery zone is substantially parallel to said detection zone, such that said activation event and receiving said soap delivery can be requested by said user's hand;

(b) orientating said user's hand to receive said soap delivery, such that at least a portion of said user's hand engages said at least one sensor, producing said at least one activation signal, whereby said activation and said soap delivery occurs substantially simultaneously;

(c) receiving said soap delivery to said user's hand within said soap delivery zone;

(d) removing said user's hand from said soap delivery zone; and (e) optionally repeating steps (a) through (d).

12. The method for initiating a soap delivery and receiving a soap delivery from said faucet system of claim 11, further comprising an electrically controlled means for controlling a water delivery, for initiating a water delivery and receiving a water delivery.

13. The method for initiating a soap delivery and receiving a soap delivery from said faucet system of claim 11, further comprising the step:

positioning of said user at a predetermined spot, located in front of said faucet system, wherein said user is capable of receiving at least one said soap delivery and at least one said water delivery from said predetermined spot.

14. The method for initiating a soap delivery and receiving a soap delivery from said faucet system of claim 11, further comprising said trajectory separation length of at least two inches, wherein said trajectory separation length is approximately the distance between said water spout, configured to produce said water stream and said soap outlet, configured to produce a soap stream.

15. The method for initiating a soap delivery and receiving a soap delivery from said faucet system of claim 11, further comprising a service light affixed to at least one delivery section to provide a communication to said user, wherein said communication is selected from the group consisting of guiding said user to said at least one delivery section and providing a system diagnostic.

16. The method for initiating a soap delivery and receiving a soap delivery from said faucet system of claim 11, further comprising said second delivery section having a top and a bottom, wherein said soap outlet is located on said bottom of said second delivery section.

17. The method for initiating a soap delivery and receiving a soap delivery from said faucet system of claim 16, further comprising said at least one sensor for controlling a soap delivery mounted on said second delivery section; wherein said least one sensor having a detection zone, is configured such that said detection zone is substantially coterminous with said soap stream.

18. The method for initiating a soap delivery and receiving a soap delivery from said faucet system of claim 11, further comprising said soap delivery line comprising a means for delivering a soap, wherein said soap is selected from the group consisting of a foam soap and a liquid soap.

19. The method for initiating a soap delivery and receiving a soap delivery from said faucet system of claim 11, further comprising said trajectory separation length of at least four inches, wherein said trajectory separation length is approximately the distance between said water spout, configured to produce said water stream and said soap outlet, configured to produce a soap stream.

20. The method for initiating a soap delivery and receiving a soap delivery from said faucet system of claim 11, further comprising a removably attachable customer replaceable cartridge, comprising a soap storage tank fluidly adapted to releasably attach to said soap delivery line, wherein configuration of said soap delivery line is selected from the group consisting of a single faucet and a faucet network.

* * * * *